US006860766B2

(12) United States Patent
Aujla et al.

(10) Patent No.: US 6,860,766 B2
(45) Date of Patent: Mar. 1, 2005

(54) ELECTRICAL CONNECTOR

(75) Inventors: Sharanjit S. Aujla, Aurora, IL (US); Hesham K. Elkhatib, Naperville, IL (US)

(73) Assignee: Cinch Connectors, Inc., Lombard, IL (US)

( * ) Notice: Subject to any disclaimer, the term of this patent is extended or adjusted under 35 U.S.C. 154(b) by 0 days.

(21) Appl. No.: 10/094,074

(22) Filed: Mar. 8, 2002

(65) Prior Publication Data

US 2003/0171036 A1 Sep. 11, 2003

(51) Int. Cl.[7] ..... H01R 13/40

(52) U.S. Cl. ..... 439/733.1; 439/862

(58) Field of Search ..... 439/862, 626, 439/733.1, 752.5

(56) References Cited

U.S. PATENT DOCUMENTS

| | | | | |
|---|---|---|---|---|
| 2,113,366 | A | | 4/1938 | Batcheller |
| 2,144,137 | A | | 1/1939 | Batcheller |
| 2,154,301 | A | | 4/1939 | Clement |
| 2,179,686 | A | | 11/1939 | Cohen |
| 3,211,874 | A | | 10/1965 | Bengtsson |
| 3,382,575 | A | * | 5/1968 | Ganneo |
| 3,431,545 | A | * | 3/1969 | Kirby ..... 439/862 |
| 3,631,372 | A | * | 12/1971 | Yamamura ..... 338/202 |
| 3,697,926 | A | | 10/1972 | Krafthefer |
| 3,810,072 | A | | 5/1974 | Moore |
| 3,815,077 | A | | 6/1974 | Anhalt et al. |
| 4,012,094 | A | | 3/1977 | VanRenssen et al. |
| 4,176,895 | A | * | 12/1979 | Aldridge |
| 4,230,383 | A | * | 10/1980 | Burnstein et al. ..... 439/620 |
| 4,735,578 | A | | 4/1988 | Reichardt et al. |
| 4,799,891 | A | | 1/1989 | Reichardt et al. |
| 4,828,515 | A | | 5/1989 | Senor et al. |
| 4,842,556 | A | | 6/1989 | Vogel |
| 4,857,001 | A | * | 8/1989 | Nakano et al. ..... 439/68 |
| 4,902,606 | A | * | 2/1990 | Patraw ..... 430/314 |
| 5,002,504 | A | * | 3/1991 | Carlson ..... 439/599 |
| 5,049,084 | A | * | 9/1991 | Bakke ..... 436/66 |
| 5,127,849 | A | | 7/1992 | Karl et al. |
| 5,314,355 | A | | 5/1994 | Halvonik |
| 5,338,231 | A | * | 8/1994 | Wilhite ..... 439/660 |
| 5,520,545 | A | | 5/1996 | Sipe |
| 5,655,913 | A | * | 8/1997 | Castaneda ..... 439/66 |
| 5,769,673 | A | | 6/1998 | Ohta et al. |
| 5,791,925 | A | * | 8/1998 | Yu ..... 439/326 |
| 5,800,184 | A | | 9/1998 | Lopergolo et al. |
| 5,800,200 | A | | 9/1998 | Brioaud et al. |
| 5,807,124 | A | | 9/1998 | Bricaud et al. |
| 5,876,217 | A | * | 3/1999 | Ito et al. ..... 439/74 |
| 5,885,090 | A | * | 3/1999 | Comstock et al. ..... 439/65 |
| 5,931,689 | A | * | 8/1999 | Patel ..... 439/346 |
| 5,980,268 | A | * | 11/1999 | Mischenko et al. ..... 439/66 |
| 5,980,323 | A | | 11/1999 | Bricaud et al. |
| 6,007,349 | A | * | 12/1999 | Distefano et al. ..... 439/71 |
| 6,033,233 | A | * | 3/2000 | Haseyama et al. ..... 439/66 |
| 6,152,789 | A | | 11/2000 | Byrd et al. |
| 6,162,103 | A | | 12/2000 | Ono |

(List continued on next page.)

*Primary Examiner*—Tho D. Ta
*Assistant Examiner*—Larisa Tsukerman
(74) *Attorney, Agent, or Firm*—Leydig, Voit & Mayer, Ltd.

(57) ABSTRACT

An electrical connector is disclosed which includes a plurality of contacts mounted to a housing. The contact includes a first contact portion, a body portion, and a second contact portion. The first contact portion includes a tongue and a pair of retention members. The second contact portion can be bifurcated. The housing includes a plurality of insertion openings which each communicate with a respective cavity. Each cavity includes a pair of side walls, a pair of guide fins, an aperture communicating with a first surface of the housing, a seat, a support, and a slot. The first contact portions of the contacts are retentively engaged with the housing and are disposed in the respective cavities. The electrical connector can be used in an electrical device, such as, a sensor, for example. The electrical device can be mated to another electrical component.

91 Claims, 24 Drawing Sheets

U.S. PATENT DOCUMENTS 6,172,594 B1 1/2001 Goo
6,231,394 B1 * 5/2001 Schnell et al. ..... 439/630
6,280,254 B1 * 8/2001 Wu et al. ..... 439/630
6,302,702 B1 * 10/2001 Audet et al. ..... 439/66
6,305,960 B1 * 10/2001 Fan ..... 439/188
6,370,257 B1 * 4/2002 Bleim et al. ..... 381/409
6,463,161 B2 * 10/2002 Klein et al. ..... 381/409

* cited by examiner

ELECTRICAL CONNECTOR

FIELD OF THE INVENTION

This invention relates generally to electrical connectors and more particularly to an electrical connector for a sensor.

BACKGROUND OF THE INVENTION

Electrical connectors are used to electrically connect one component to another component. Depending upon the particular application, an electrical connector may be required to satisfy certain criteria, such as, contact resistance, compliance or deflection distance, force required to achieve compliance, ease of assembly, and cost to manufacture.

A sensor is a device which senses the state of an environment. For example, a sensor can sense the temperature or pressure. Sensors can be used in vehicles, such as automobiles, to sense the temperature of the engine or the pressure in a braking system. The sensor can be connected to a processing unit, such as, a computer, by wires and a printed circuit board. Economic considerations make it desirable for the sensor to be connected to the processing unit in a convenient and low cost manner.

In one design, a flexible strip has been used as a connector. The strip is mechanically secured by solder. In another design, wire bonding to lead frames is used to provide the electrical connection. Both of these designs yield a fairly large package and require a complex assembly process.

In view of the foregoing, there exist various needs in the art. One such need is for an electrical connector which is easily mounted to provide a reliable electrical connection. Another need is for a compact, low profile electrical connector.

SUMMARY OF THE INVENTION

The electrical connector according to the present invention addresses these disadvantages, problems and other needs. The electrical connector can be used as an interposer in a fluid pressure sensor for an electronic anti-lock braking system, for example. The electrical connector provides a reliable mechanical pressure connection to a pad on a printed circuit board, for example. The electrical connector is readily installed and can be made using conventional manufacturing techniques.

There is provided an electrical connector including a plurality of contacts mounted to a housing. The electrical connector can be used in an electrical device, such as a sensor, for example, including a pressure sensor or a temperature sensor. The electrical device can be mated to another electrical component.

The contact includes a first contact portion, a body portion, and a second contact portion. The first contact portion can provide a surface for electrical connection to a spring-loaded pin contact, for example. The first contact portion is positively retained in the housing. The first contact portion includes a protrusion in the form of a tongue, for example, and a pair of retention members. The body portion is resiliently flexible and configured to allow for a low-profile contact that provides a high degree of compliancy without overstressing the contact. The second contact portion can provide a surface for electrical connection to a pad on a printed circuit board, for example. The second contact portion can be bifurcated.

The housing includes a first surface, a second surface, and a perimeter surface therebetween. The perimeter surface is broken by a plurality of insertion openings which each communicate with a respective cavity. Each cavity includes an aperture which communicates with the first surface of the housing. The first contact portions of the contacts are retentively engaged with the housing and are disposed in the respective cavities. The first contact portions are respectively accessible through the apertures of the housing.

Each cavity includes a seat and a support which both span between a pair of side walls of the cavity. The seat and the support are offset vertically from each other such that the first contact portion can fit therethrough. Each cavity includes a pair of guide fins projecting inwardly toward each other from the side walls. The guide fins facilitate the insertion of the contact into the cavity. The retention members of the contact engage the side walls of the cavity to positively retain the contact in the cavity and to prevent the contact from being inadvertently removed from the cavity. Each cavity of the housing can include a slot. The slot can be configured to receive the tongue of the contact therethrough. The cooperative arrangement of the tongue with the slot prevents the contact from moving along the vertical axis and prevents the contact from pivoting about the contact seat that it is resting upon.

The inventive features of the present invention will become apparent to one of ordinary skill in the art upon reading the detailed description, in conjunction with the accompanying drawings, provided herein.

Reference is sometimes made herein to the "top," "bottom," "upper," "lower," or other regions of the electrical connector and its various components. It should be understood that these terms are used solely for convenient reference, inasmuch as the electrical connector can be used omnidirectionally.

DESCRIPTION OF THE EMBODIMENTS

Figure 23:
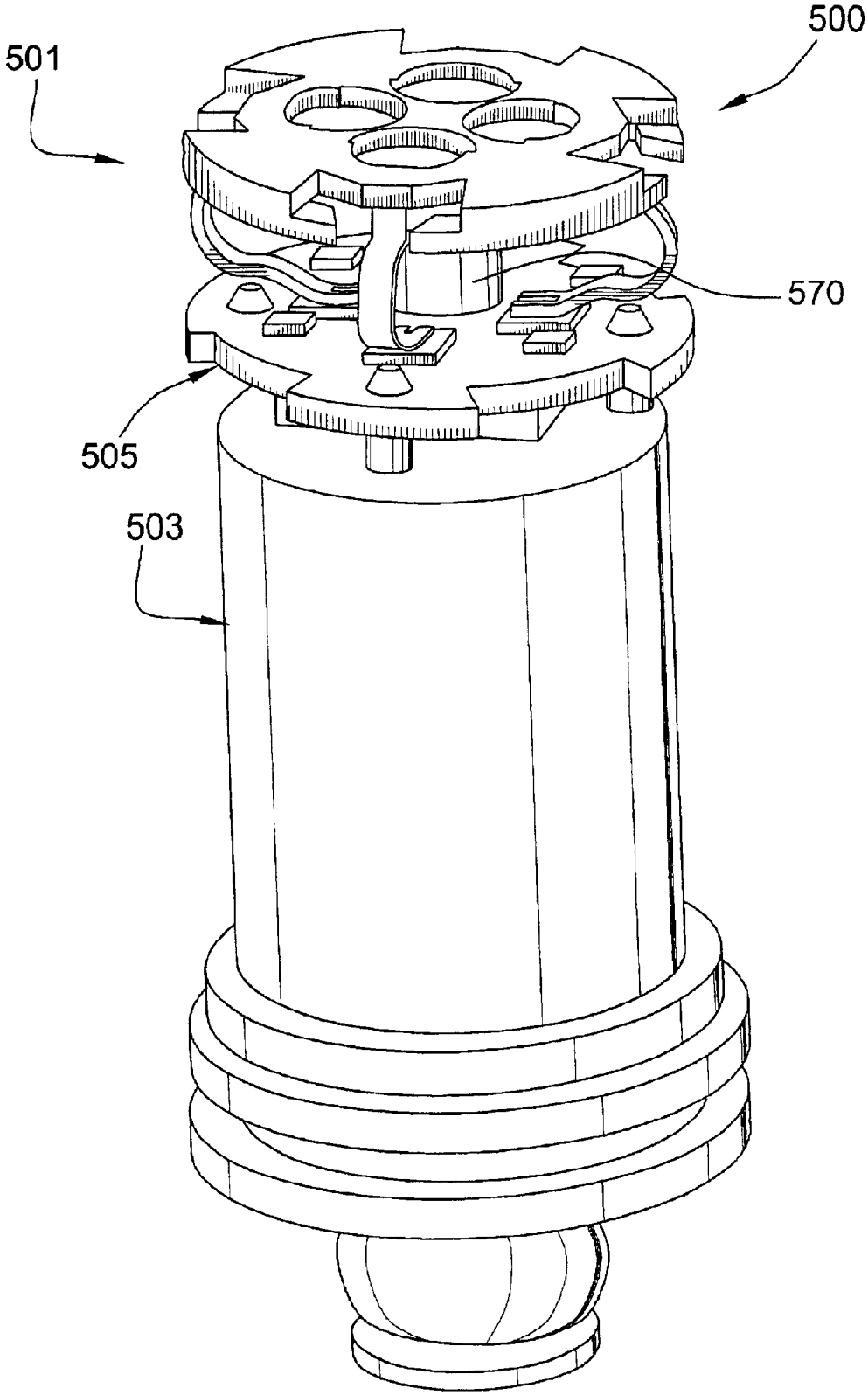
FIG. 23 is a perspective view of a sensor with the electrical connector of FIG. 1 installed therein.

Turning now to the drawings, there is shown in FIGS. 1–6 an illustrative electrical connector 100 according to the present invention. The electrical connector 100 can provide a reliable mechanical pressure connection between itself and the component to which it is connected. The electrical connector 100 is compact, presenting a low-profile configuration. The electrical connector 100 can be used in a sensor, for example, as shown in FIG. 23.

Referring to FIGS. 1–6, the connector 100 includes a housing 102 and a plurality of resiliently flexible electrical contacts 111, 112, 113, 114. The contacts 111, 112, 113, 114 are mounted to the housing 102. The contacts 111, 112, 113, 114 are electrically conductive and are resilient such that the contacts can be compressively engaged to exert a responsive contact pressure. The housing 102 can act as an electrical insulator. For example, the housing 102 can act to maintain the contacts in electrical isolation from each other.

Figure 1:
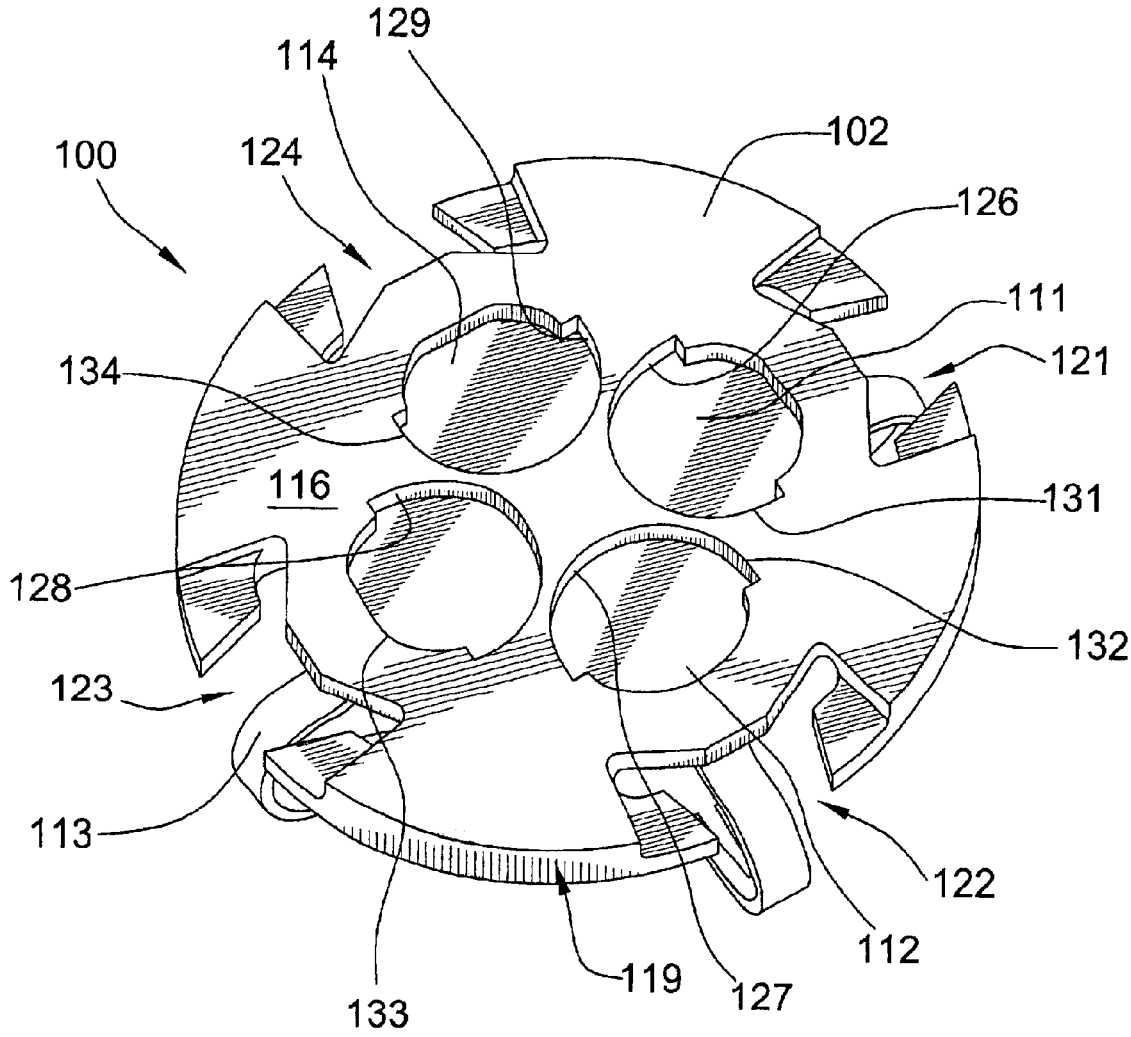
FIG. 1 is a top perspective view of an electrical connector in accordance with the present invention.
Figure 2:
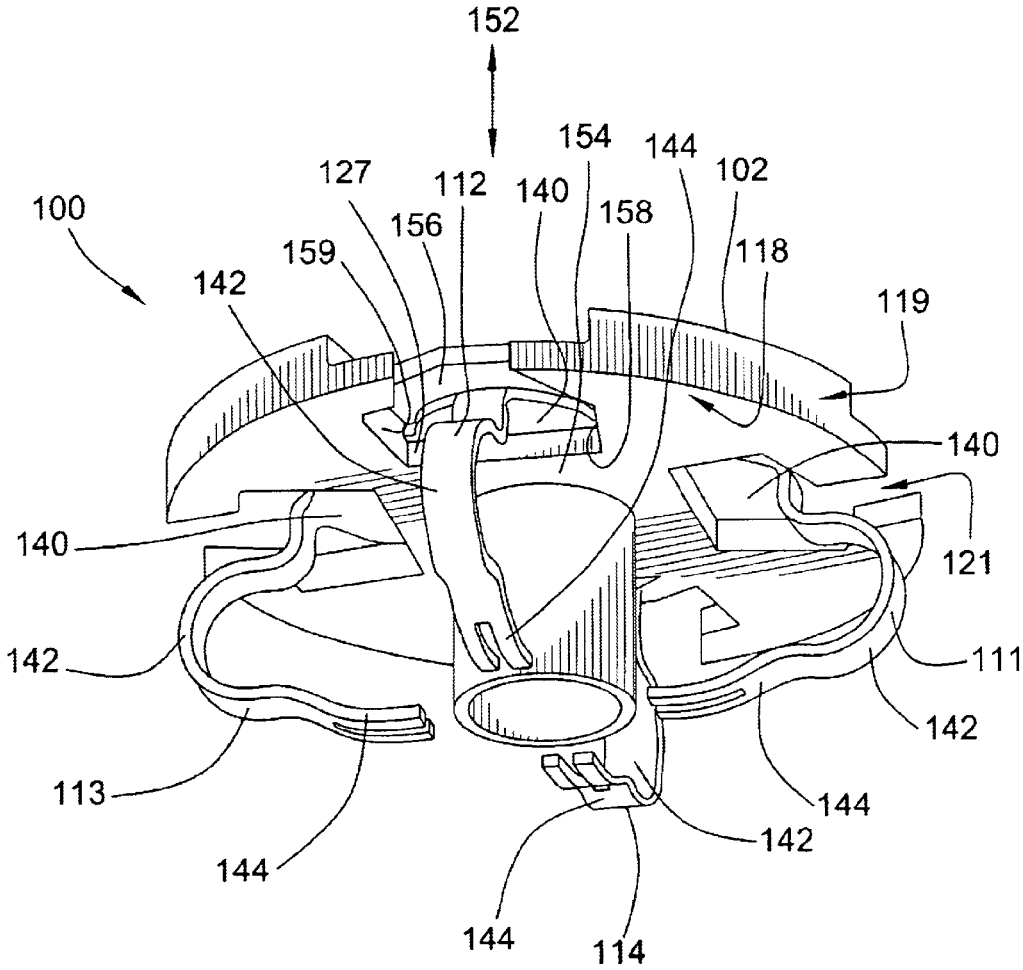
FIG. 2 is a bottom perspective view of the connector of FIG. 1.

Referring to FIGS. 1 and 2, the housing 102 includes a first surface 116, a second surface 118, and a perimeter surface 119 therebetween. Referring to FIG. 1, the perimeter surface 119 is broken by a plurality of insertion openings 121, 122, 123, 124 which each communicate with a respective cavity 126, 127, 128, 129. Each cavity 126, 127, 128, 129 includes an aperture 131, 132, 133, 134 which communicates with the first surface 116 of the housing 102.

Referring to FIG. 2, each contact 111, 112, 113, 114 includes a first contact portion 140, a body portion 142, and a second contact portion 144. Referring to FIG. 1, the first contact portions 140 of the contacts 111, 112, 113, 114 are retentively engaged with the housing 102 and are disposed in the cavities 126, 127, 128, 129, respectively. The first contact portions 140 are respectively accessible through the apertures 131, 132, 133, 134 of the housing 102.

Each illustrative contact 111, 112, 113, 114 is mounted to the housing 102 in the same manner. Accordingly, it will be understood that the description of the mounting of any contact is applicable to each of the other contacts, as well. In other embodiments, the mounting of each contact can be varied as a group or separately.

Referring to FIG. 2, to prevent substantial movement of the second contact 112 along a vertical axis 152, the first contact portion 140 of the contact 112 can engage a contact seat 154 and a contact support 156 of the second cavity 127. The second contact 112 is disposed between the contact seat 154 and the contact support 156. The seat 154 and the support 156 span between a pair of side walls 158, 159 of the second cavity 127. The seat 154 and the support 156 are offset vertically from each other such that the first contact portion 140 can fit therethrough.

Figure 3:
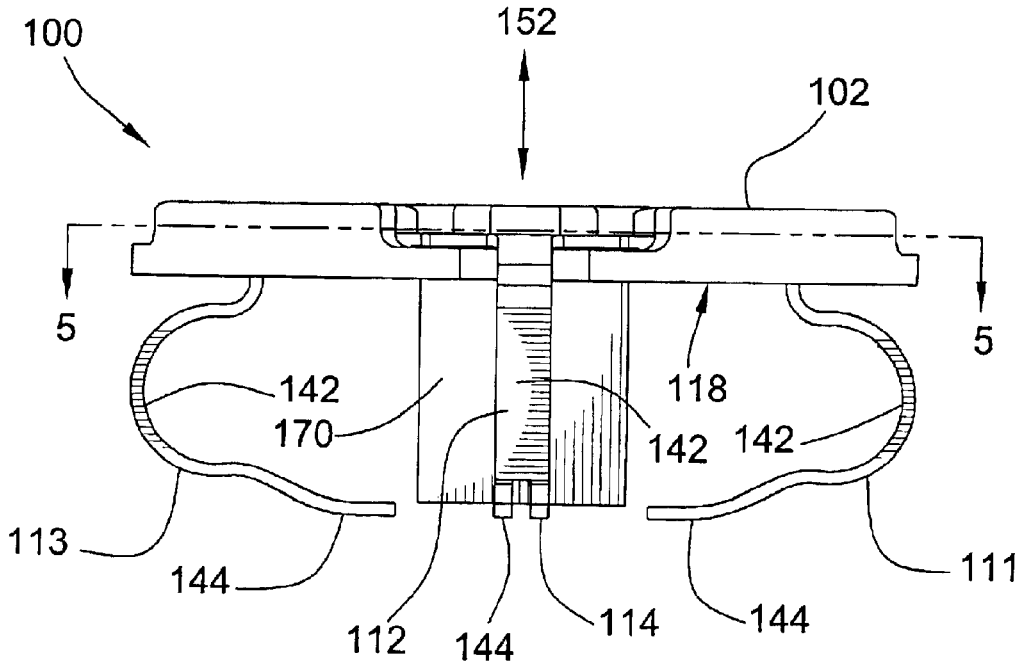
FIG. 3 is a side elevational view of the connector of FIG. 1.

Referring to FIGS. 2 and 3, the body portion 142 and the second contact portion 144 of each contact 111, 112, 113, 114 depend from the second surface 118 of the housing 102.

Referring to FIG. 3, the housing 102 includes a centrally-disposed cylinder 170. The cylinder 170 can act to provide an over-stress prevention feature by limiting the amount the contacts 111, 112, 113, 114 can compress along the vertical axis 152 to a selected length. The cylinder 170 is configured to selectively limit the compressive deflection of the contacts 111, 112, 113, 114. The contacts 111, 112, 113, 114 can engage another component or another surface, for example, to cooperatively impart a compressive force thereupon.

Figure 4:
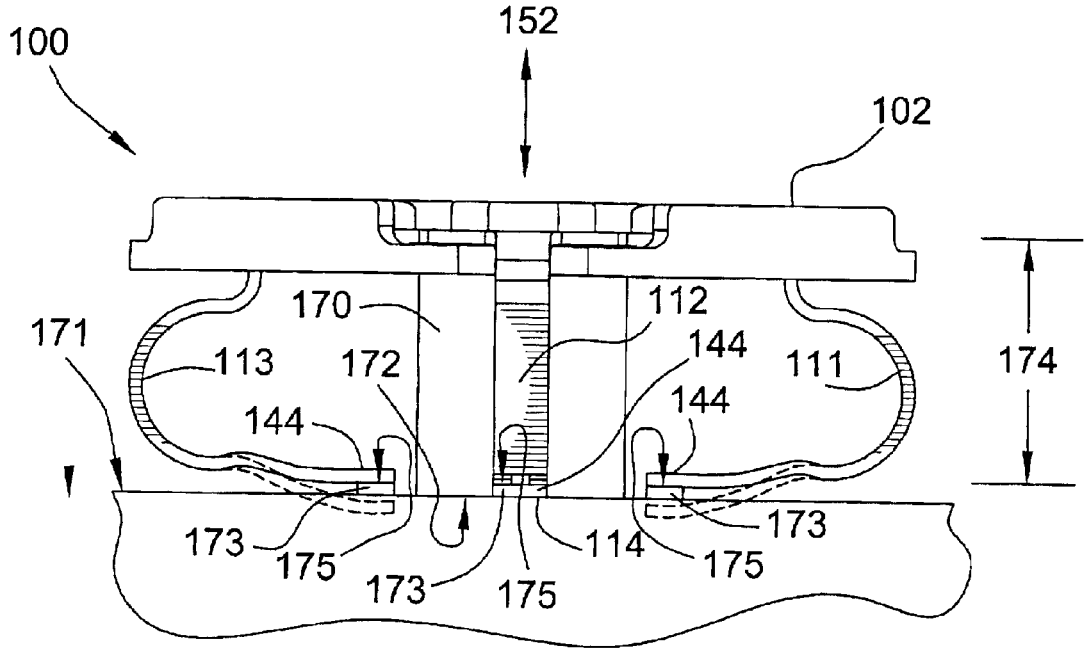
FIG. 4 is a side elevational view as in FIG. 3 showing the contacts in a compressed position.

Referring to FIG. 4, the electrical connector 100 is compressively engaged with a surface 171, thereby imparting a compressive force along the vertical axis 152 upon the contacts 111, 112, 113, 114. The contacts 111, 112, 113, 114 are in a compressed position wherein the bottom contact portions 144 are displaced from a normal position, shown in FIG. 4 in hidden lines, toward the housing 102. A bottom surface 172 of the cylinder 170 is in contact with the surface 171. The bottom contact portions 144 are in contact with contact pads 173 on the surface 171. The contacts 111, 112, 113, 114 are compressed along the vertical axis 152 to a selected length 174. The contacts can be placed in other compressed positions.

For the illustrative length 174, contact surfaces 175 of each of the bottom contact portions 144 are disposed in contacting relation with the contact pads 173.

During the compressive engagement of the connector 100 with the surface 171, the bottom contact portions 144 of the contacts can move toward the housing 102 only until the cylinder 170 engages the surface 171. The cylinder 170 can act to withstand the compressive force between the connector 100 and the surface 171 without deflecting, thereby preventing further compressive movement of the contacts 111, 112, 113, 114. In other embodiments, the size of the cylinder and/or the selected length of allowed compression can be varied.

Figure 5:
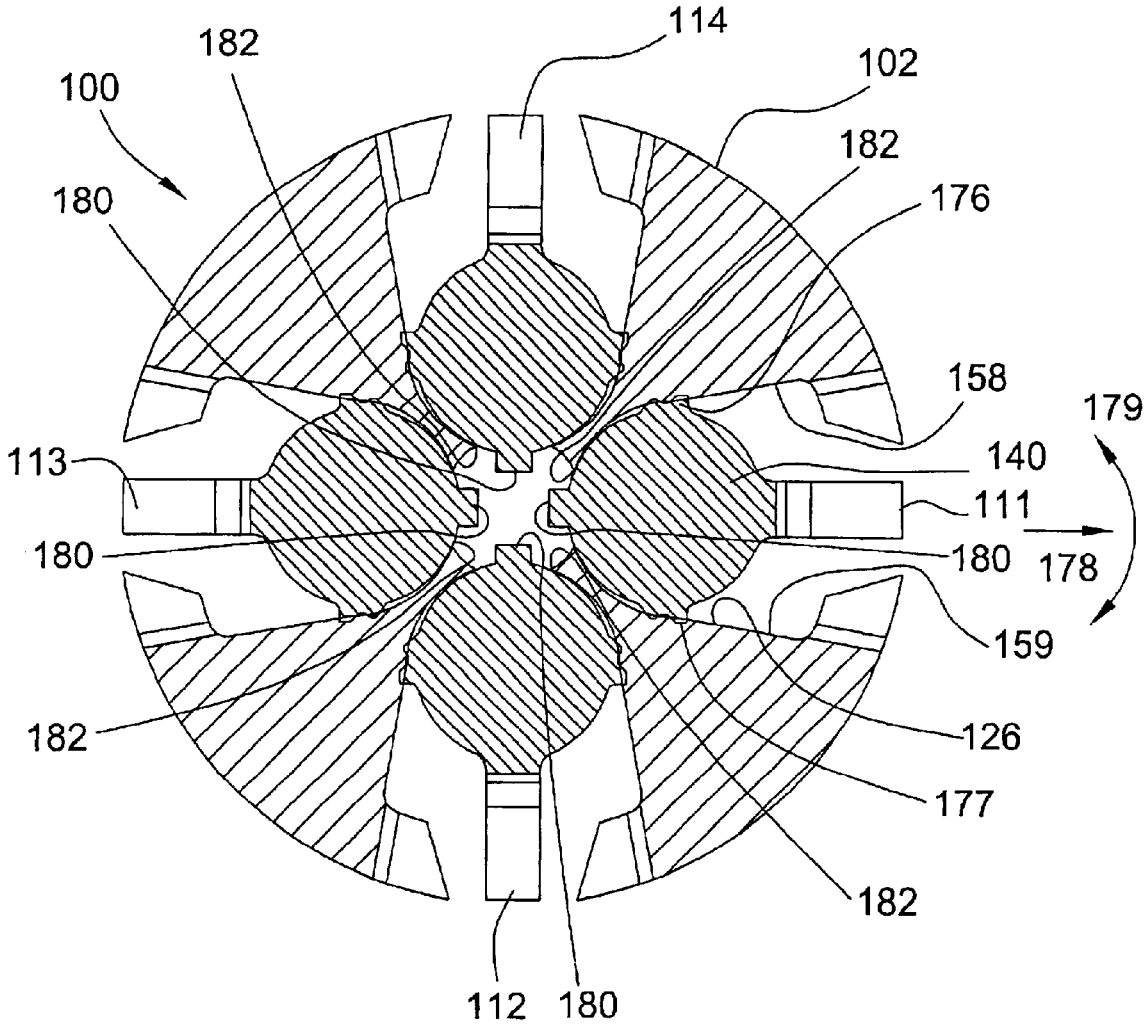
FIG. 5 is a cross-sectional view of the connector taken along line 5—5 in FIG. 3.

Referring to FIG. 5, the first contact portion 140 of the first contact 111 retentively engages the side walls 158, 159 of the first cavity 126 to positively retain the contact in the cavity and to prevent the contact from being inadvertently removed from the cavity. The first contact portion 140 of the contact 111 includes a pair of retention members 176, 177. The retention members 176, 177 interferingly engage the side walls 158, 159, respectively, to retain the contact portion 140 in the cavity 126 such that the contact portion is seated on the contact support. The retention members 176, 177 act to resist movement of the contact 111 in a removal direction 178.

The retention members 176, 177 engage the side walls 158, 159 such that the first contact 111 is substantially constrained from rotating about the vertical axis, as indicated by a double-headed arrow 179 in FIG. 4. The retention members 176, 177 are interferingly engaged with the respective side walls 158, 159 of the first cavity 126 to prevent the rotation of the contact 111 about the vertical axis 152.

Figure 6:
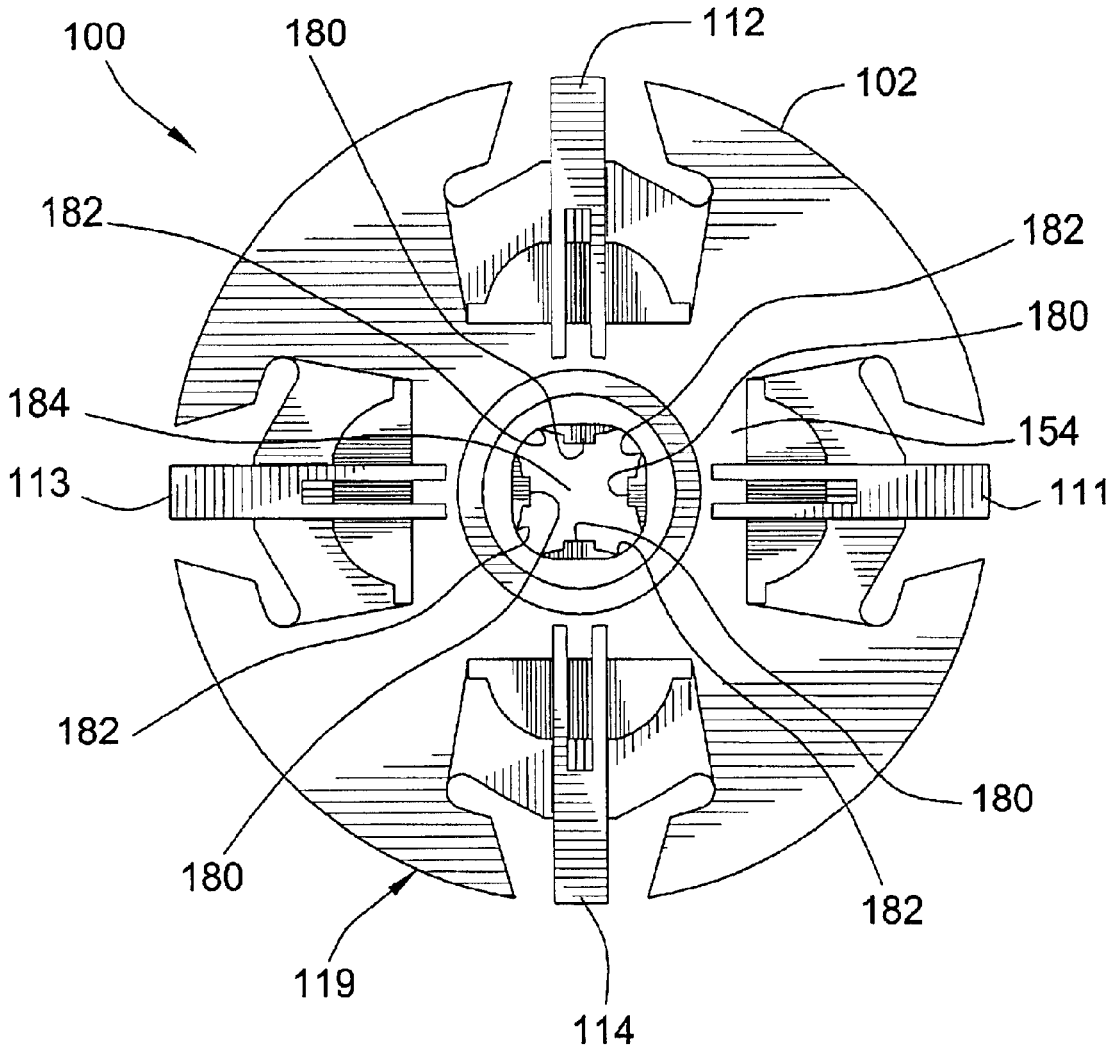
FIG. 6 is a bottom plan view of the connector of FIG. 1.
Figure 13:
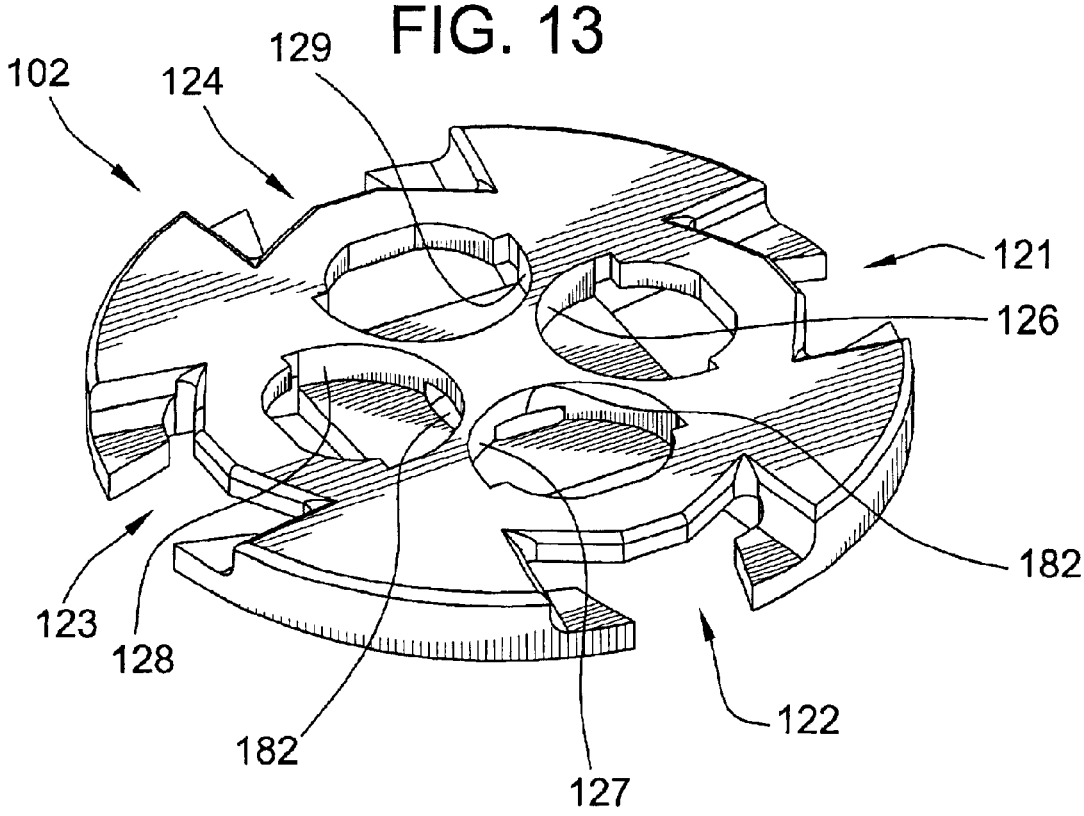
FIG. 13 is a top perspective view of a housing of the connector of FIG. 1.

Referring to FIGS. 5 and 6, each contact can include a protrusion in the form of a tongue 180, for example, and each cavity of the housing 102 can include a slot 182, as also shown in FIG. 13. The slot 182 can bc configured to receive the tongue 180 therethrough. The tongue 180 of the first contact 111 extends through the slot 182 of the first cavity 126. The cooperative arrangement of the tongue 180 with the slot 182 further prevents the contact 111 from moving along the vertical axis and prevents the contact 111 from pivoting about the contact seat 154 that it is resting upon.

Referring to FIG. 6, the housing 102 is generally circular-shaped. The perimeter surface 119 defines the outer circumference of the housing 102. The contacts 111, 112, 113, 114 are radially disposed in a substantially uniform manner about a central recess 184 of the housing 102. The contacts 111, 112, 113, 114 are disposed at about 90° to each adjacent contact. The tongues 180 of each contact 111, 112, 113, 114 extend into the central recess 184.

The illustrative electrical connector 100 includes four contacts. The contacts 111, 112, 113, 114 are disposed in substantially uniform spaced relation to each other. The contacts are each made from a copper alloy, for example, or any other suitable electrically-conductive material. The contacts need not be made from the same material. In other embodiments, the number and/or location of contacts can be varied. The illustrative housing 102 is made from a high performance thermoplastic, such as, a liquid crystal polymer, nylon, or polybutylene terephthalate (PBT), for example. In other embodiments, the housing 102 can be made from any other suitable dielectric material.

Figure 7:
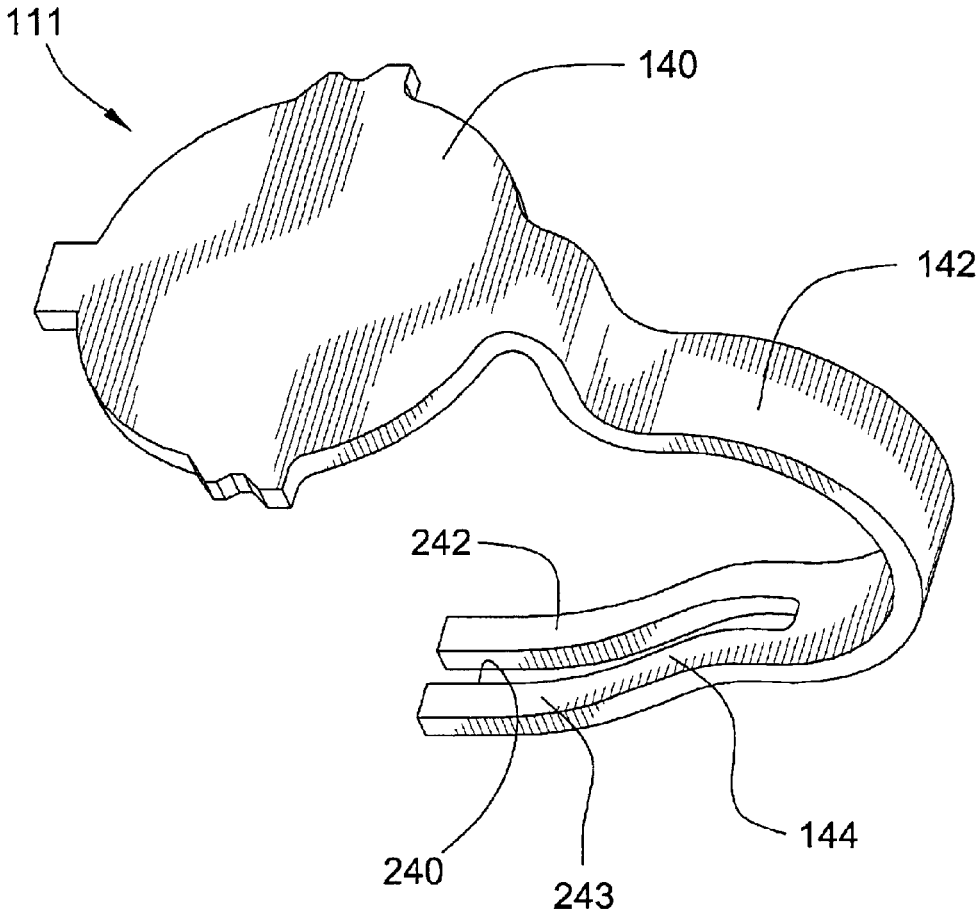
FIG. 7 is a perspective view of a contact of the connector of FIG. 1.

Referring to FIG. 7, the first contact 111 is shown. The illustrative second, third, and fourth contacts are similar to the first contact 111 in construction and function. Accordingly, only the first contact 111 will be discussed in detail. It will be understood that the description of the first contact is applicable to each of the other contacts, as well. In other embodiments, one or more of the contacts can be different from at least one of the other contacts. The contact 111 includes the first contact portion 140, the body portion 142, and the second contact portion 144.

Figure 8:
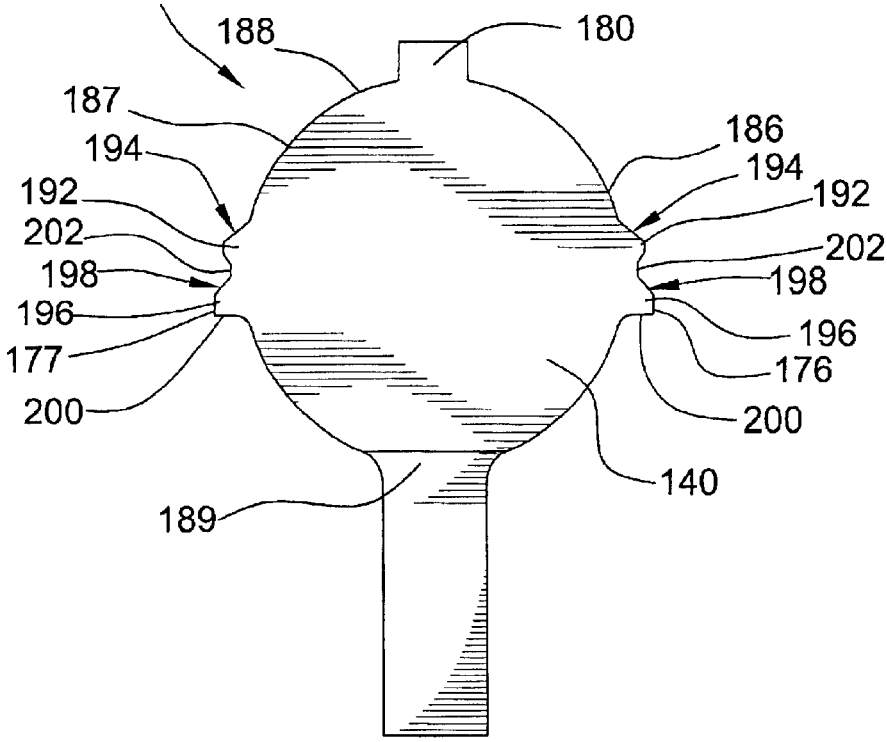
FIG. 8 is a top plan view of the contact of FIG. 7.

Referring to FIG. 8, the first contact portion 140 of the contact 111 has a generally circular shape. The first contact portion 140 includes the tongue 180 and the retention members 176, 177. The retention members 176, 177 are disposed on opposing sides 186, 187 of the first contact portion 140. The tongue 180 is disposed on an insertion end 188 of the first contact portion 140. The tongue 180 opposes a necked area 189.

The retention members 176, 177 are similar to each other, each being a mirror image of the other. Each retention member 176, 177 includes a first protrusion 192 having a first ramped surface 194 and a second protrusion 196 having a second ramped surface 198 and a shoulder 200. The first ramped surfaces 194 of the retention members 176, 177 incline outward away from each other, moving from the insertion end 188 to the necked area 189. The second ramped surfaces 198 of the retention members 176, 177 incline outward away from each other, moving from the insertion end 188 to the necked area 189. The shoulders 200 of the retention members 176, 177 are respectively disposed at the extremity of the retention members 176, 177 that is closest to the necked area 189. The first and second protrusions 192, 196 define a recess 202 disposed therebetween.

Figure 9:
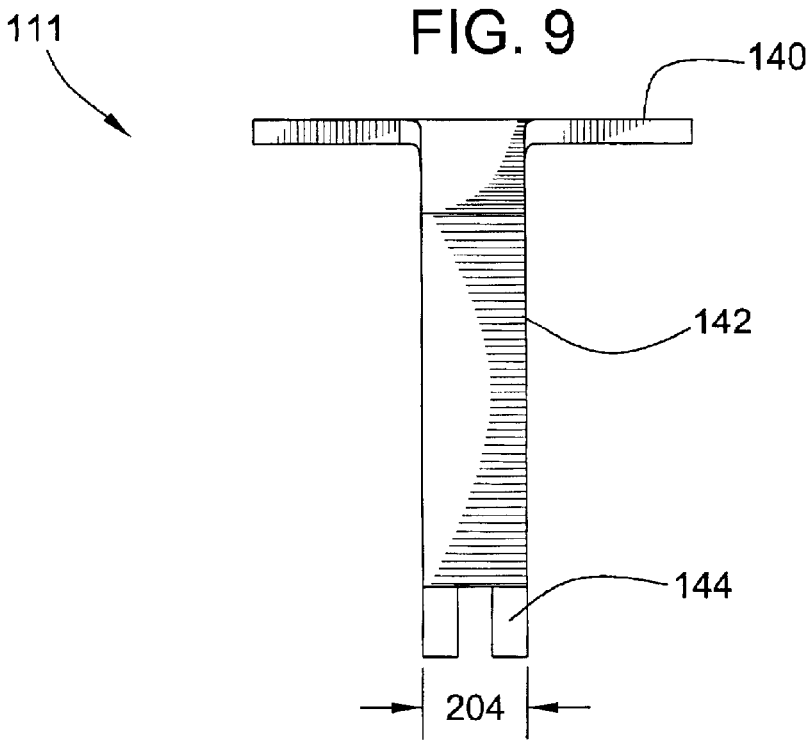
FIG. 9 is a rear elevational view of the contact of FIG. 7.

Referring to FIG. 9; the first contact portion 140 of the contact 111 is generally planar. The body portion 142 and the second contact portion 144 are substantially the same width, as indicated in FIG. 9 by a dimensional arrow 204.

Figure 10:
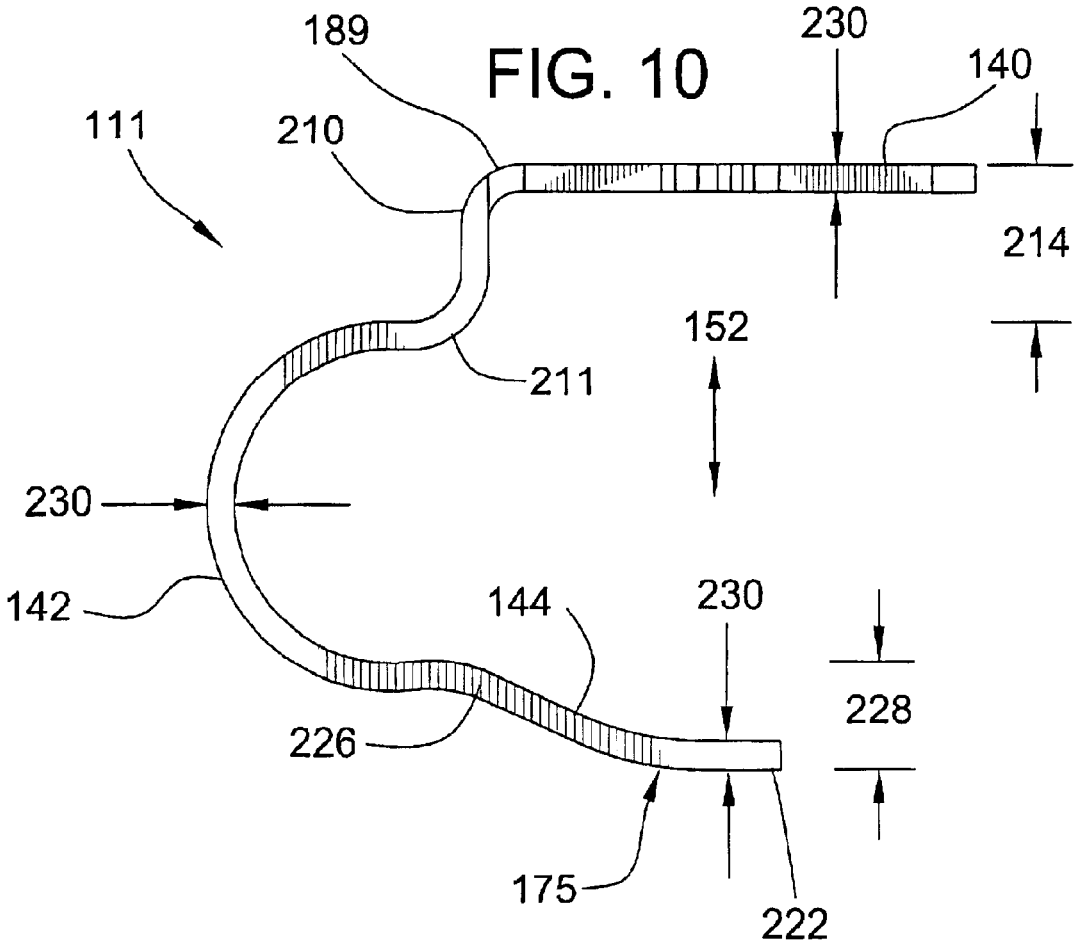
FIG. 10 is a side elevational view of the contact of FIG. 7.

Referring to FIG. 10, the illustrative body portion 142 of the contact 111 is resiliently flexible and acts as a spring. The body portion 142 is generally C-shaped. The body portion 142 is located between the first contact portion 140 and the second contact portion 144. First and second bights 210, 211 are interposed between the body portion 142 and the first contact portion 140. The first bight 210 is disposed adjacent the necked area 189. The bights 210, 211 define a general S-shape and act to offset the body portion 142 relative to the first contact portion 140 a selected distance 214 along the vertical axis 152.

The second contact portion 144 includes the contoured contact surface 175, which is generally convex with a generally planar end 222. The contact surface 175 is configured such that at least a portion of the contact surface 175 can engage a planar contact pad. The contact surface 175 can maintain electrical continuity with the contact pad over a selected range of compressive and tensile travel of the contact 111 in the vertical axis 152. The second contact portion 144 includes an offset segment 226 configured to offset the end 222 of the second contact surface 175 a selected distance 228 along the vertical axis 152 relative to the body portion 142.

The first and second contact portions 140, 144 and the body portion 142 are substantially the same thickness as indicated in FIG. 9 by dimensional arrows 230. The contact 111 can be made from metal by conventional stamping and forming techniques, for example.

Figure 11:
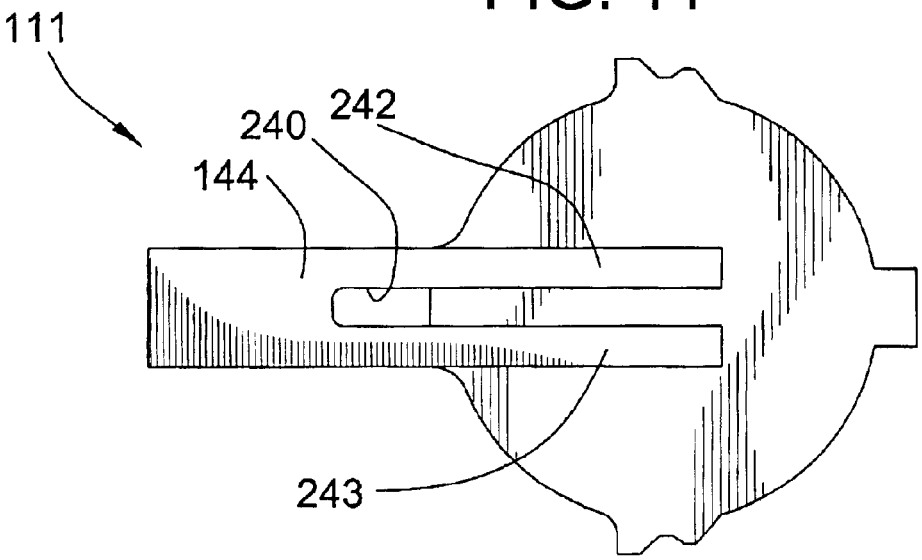
FIG. 11 is a bottom plan view of the contact of FIG. 7.

As shown in FIGS. 7 and 11, the second contact portion 144 of the contact 111 can include a slot 240. The slot 240 bifurcates the second contact portion 144 to define a pair of arms 242, 243. The arms 242, 243 enhance the spring capabilities of the contact and provide a plurality of contact points for electrically engaging a contact pad mounted on a printed circuit board, for example.

Figure 12:
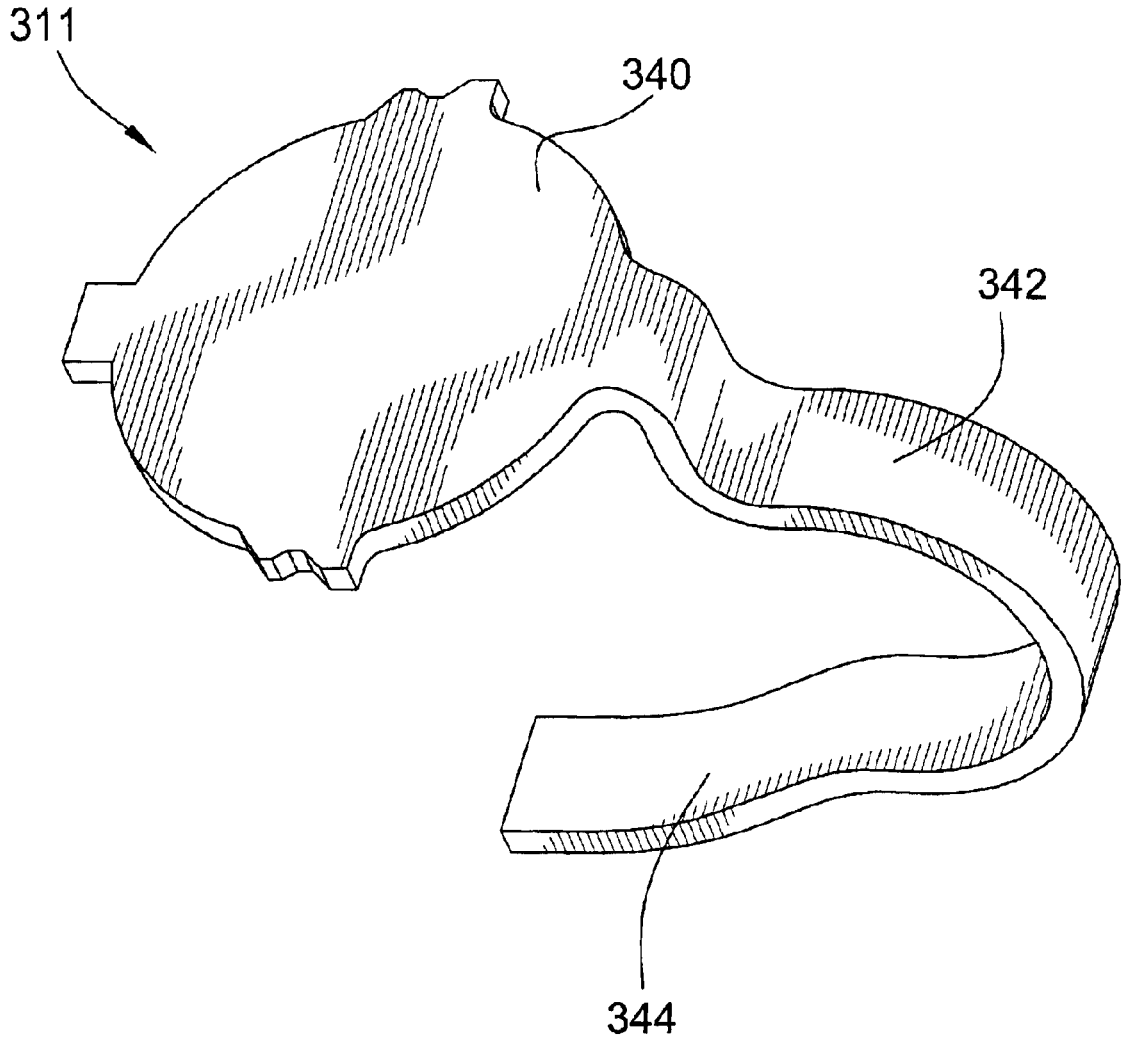
FIG. 12 is a perspective view of another embodiment of a contact.

Referring to FIG. 12, another embodiment of a contact 311 is shown. The contact 311 includes a first contact portion 340, a body portion 342, and a second contact portion 344. The second contact portion 344 does not include a slot. The contact 311 shown in FIG. 12 is similar in other respects to the contact 111 shown in FIGS. 7–11.

Figure 14:
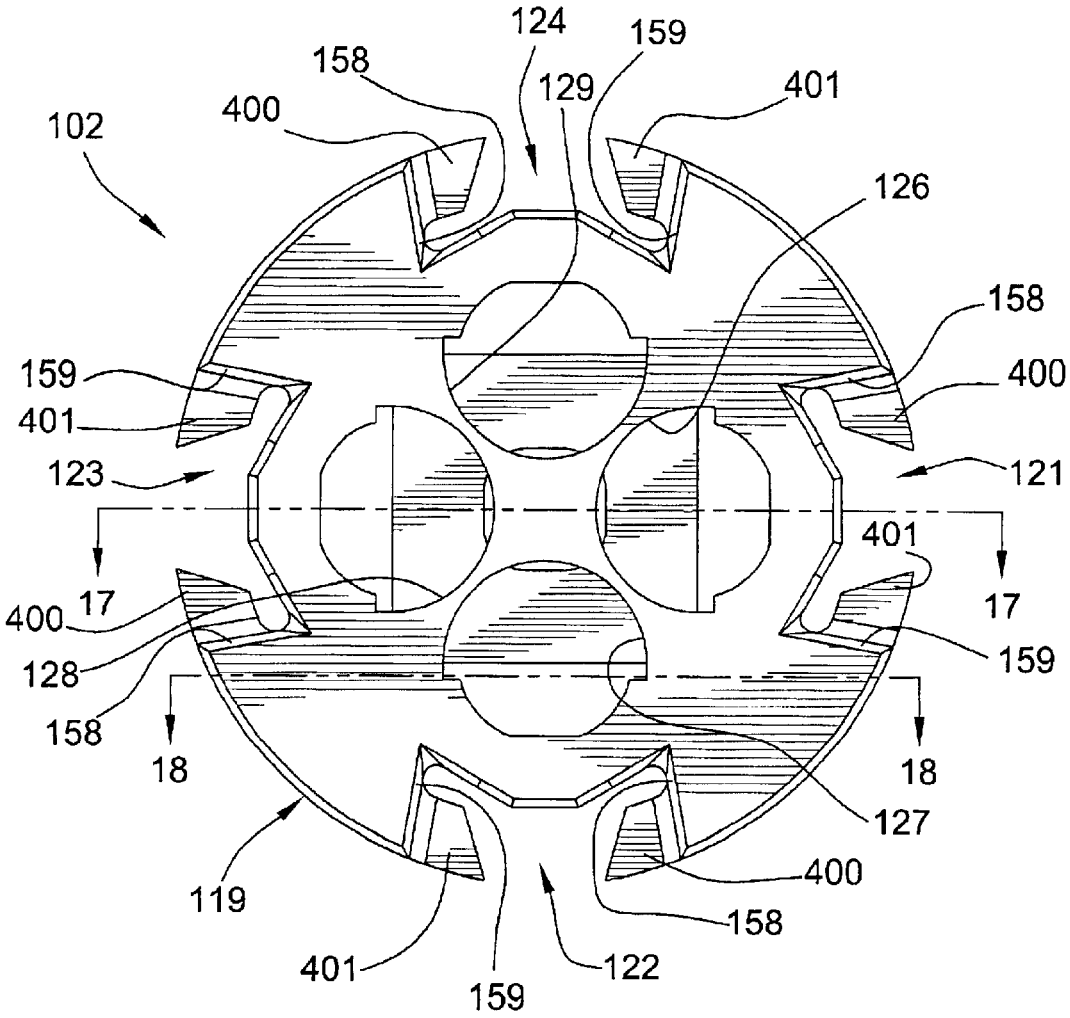
FIG. 14 is a top plan view of the housing of FIG. 13.
Figure 15:
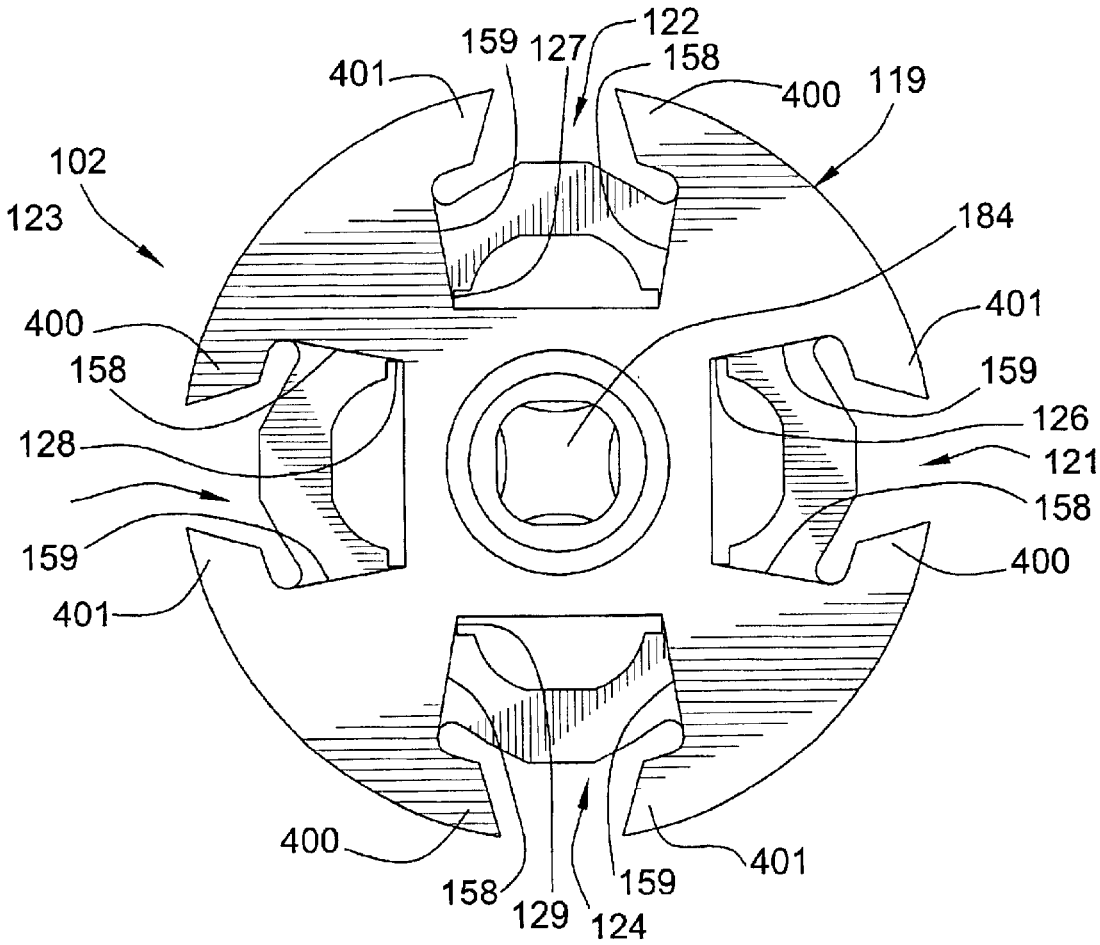
FIG. 15 is a bottom plan view of the housing of FIG. 13.

Referring to FIG. 13, the housing 102 is shown with no contacts inserted therein. The insertion openings 121, 122, 123, 124 are similar to each other. The cavities 126, 127, 128, 129 are similar to each other. Accordingly, it will be understood that the description of one insertion opening and of one cavity is applicable to any of the other insertion openings and cavities, respectively Referring to FIGS. 14 and 15, the side walls 158, 159 of each cavity 126, 127, 128, 129 are configured to facilitate the insertion of the contact through the insertion opening and into the cavity for retentive engagement with the housing 102. The side walls 158, 159 of each cavity 126, 127, 128, 129 are tapered inwardly toward each other, moving from the perimeter surface 119 to the central recess 184, as shown in FIG. 15. The insertion openings 121, 122, 123, 124 are thereby configured to readily receive the contacts.

Each cavity 126, 127, 128, 129 includes a pair of guide fins 400, 401, projecting inwardly toward each other from the side walls 158, 159, respectively. The guide fins 400, 401 act to align the contact along the vertical axis 152 with a passage 406 disposed between the contact seat 154 and the contact support 156, as seen in FIG. 17.

Figure 16:
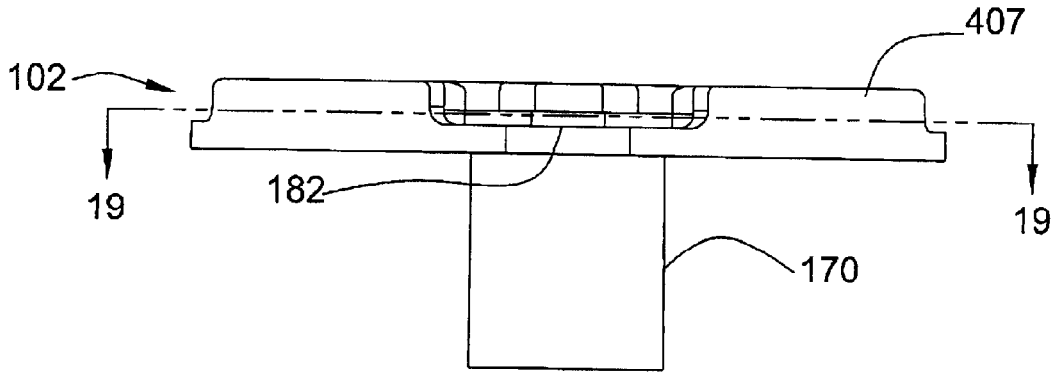
FIG. 16 is a side elevational view of the housing of FIG. 13.
Figure 17:
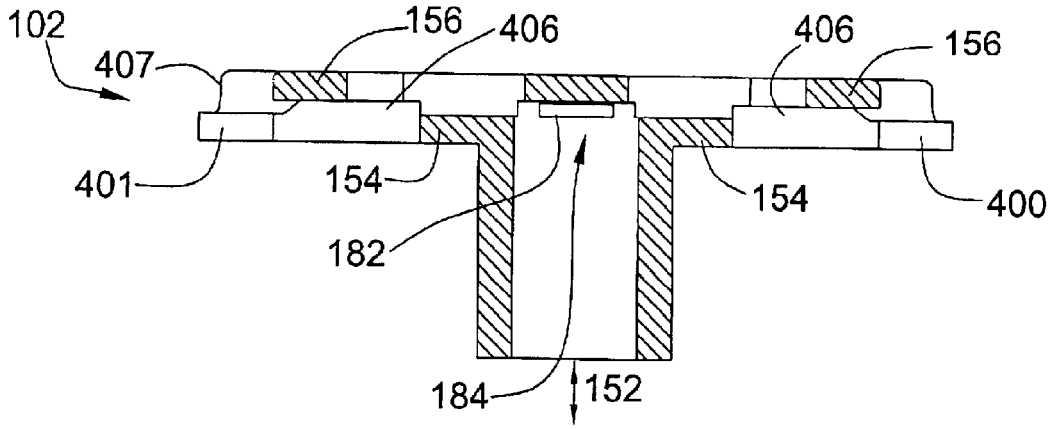
FIG. 17 is a cross-sectional view taken along line 17—17 in FIG. 14.

Referring to FIGS. 16 and 17, the housing 102 includes a substantially planar top portion 407 with the cylinder 170 depending therefrom. The housing 102 is substantially T-shaped. Each slot 182 communicates with the central recess 184.

Figure 18:
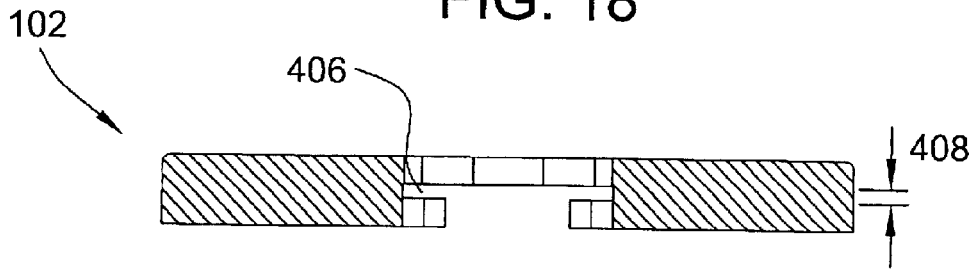
FIG. 18 is a cross-sectional view taken along line 18—18 in FIG. 14.

Referring to FIG. 18, the passage 406 of the housing 102 is configured to allow the upper contact portion of the contact to fit therethrough. The passage 406 can have a height 408 that can be configured to substantially correspond with the thickness 230 of the upper contact portion as shown in FIG. 9. In other embodiments, the height of the passage can be varied.

Figure 19:
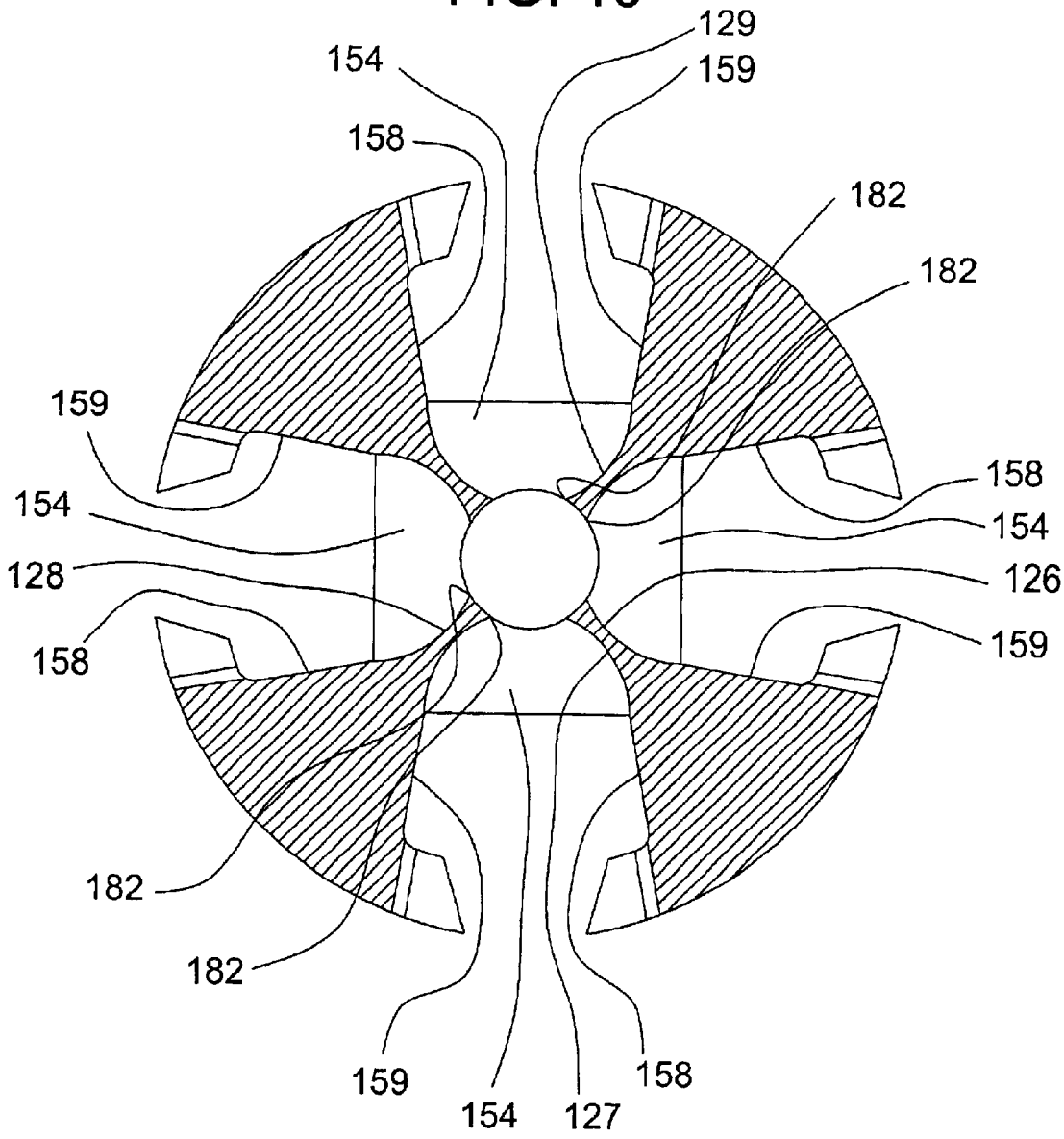
FIG. 19 is a cross-sectional view take along line 19—19 in FIG. 16.

Referring to FIG. 19, the side walls 158, 159 of each cavity 126, 127, 128, 129 converge toward each other such that when the contact is seated on the contact seat 154 the side walls 158, 159 can retentively engage the contact. The configuration of the side walls 158, 159 facilitates the insertion of the tongue of the contact into the slot 182 of each cavity 126, 127, 128, 129. The side walls 158, 159 can be configured such that when the retention members of the contact retentively engage the side walls 158, 159, the tongue of the contact is aligned with the slot 182 of the cavity.

Figure 20:
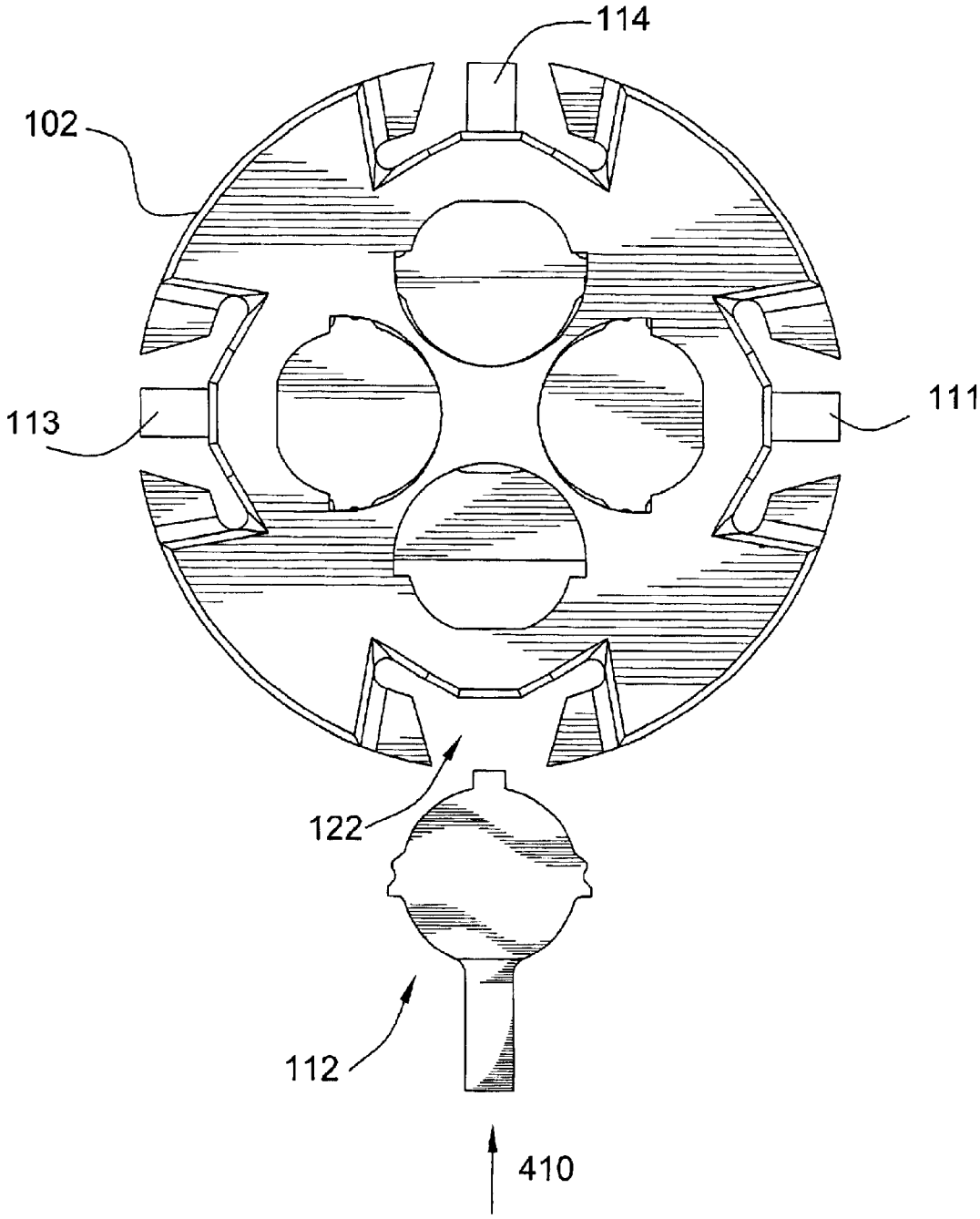
FIG. 20 is a partially exploded, top plan view of the connector of FIG. 1
Figure 21:
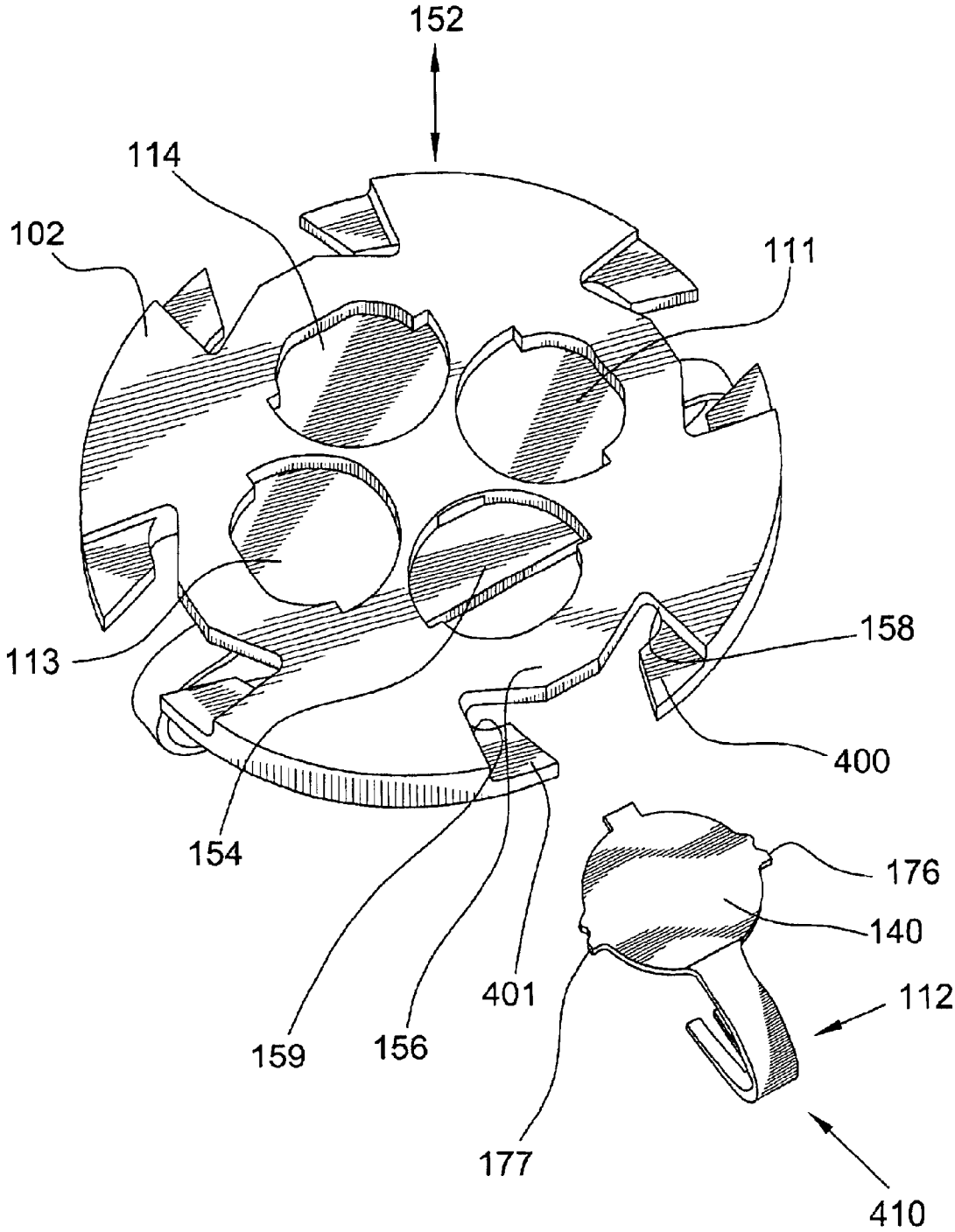
FIG. 21 is a perspective view of the connector of FIG. 1 with one of the contacts partially inserted into the housing.
Figure 22:
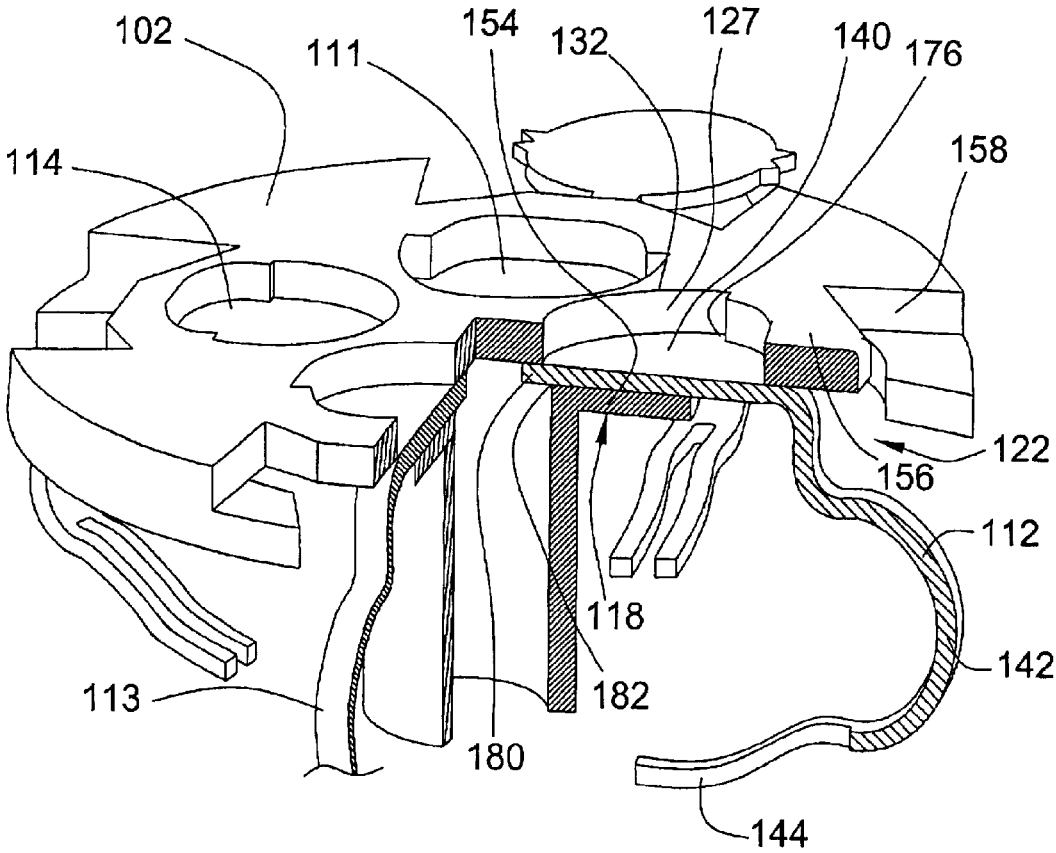
FIG. 22 is a partially in section perspective view of the connector of FIG. 1.

Referring to FIGS. 20–22, a sequence of mounting the contact 112 to the housing 102 is shown. The insertion process can be the same for each of the other contacts 111, 113, 114.

Referring to FIG. 20, the second contact 112 can be inserted into the second insertion opening 122 of the housing 102 by moving the contact 112 in an insertion direction 410.

Referring to FIG. 21, the first contact portion 140 of the contact 112 is in contact with the guide fins 400, 401 of the housing 102. The tongue of the first contact portion 140 is disposed between the contact seat 154 and the contact support 156. Continued movement of the contact 112 in the insertion direction 410, which is substantially perpendicular to the vertical axis 152, can allow the retention members 176, 177 of the contact 112 to retentively engage the side walls 158, 159 of the cavity 127.

Referring to FIG. 22, the contact 112 is mounted to the housing 102. The first contact portion 140 of the contact 112 is disposed between the contact seat 154 and the contact support 156 and is fully seated on the contact seat 154. The tongue 180 of the contact 112 is disposed in the slot 182 of the cavity 127. The first retention member 176 retentively engages the first side wall 158 of the cavity 127. The second retentive member and the second side wall are similarly retentively engaged.

The configuration of the first contact portion 140 and its arrangement with the side walls of the cavity 127 selectively prevent the contact 112 from being removed from the cavity 127 through the insertion opening 122. The upper contact portion 140 is exposed through the aperture 132. The body portion 142 and the lower contact portion 144 extend below the second surface 118 of the housing 102.

Referring to FIGS. 23–29, an electrical connector 500 according to the present invention can be assembled into an electrical device 501, such as, a temperature sensor or a pressure sensor, for example. The illustrative electrical device 501 is a pressure sensor.

Figure 24:
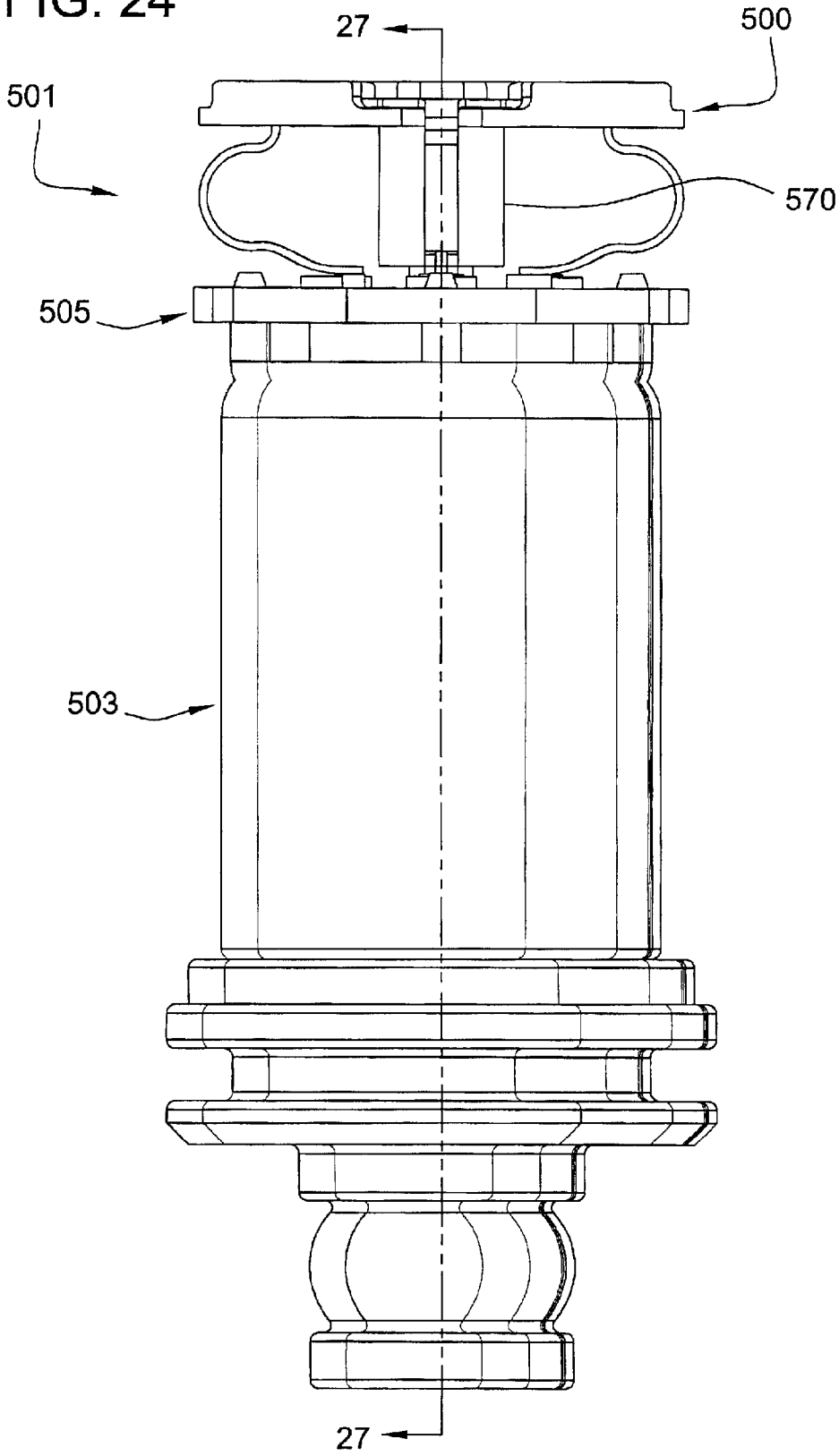
FIG. 24 is a side elevational view of the sensor of FIG. 23.

Referring to FIGS. 23 and 24, the electrical device 501 includes the electrical connector 500, a pressure input assembly 503, and a printed circuit board 505 which is disposed between the pressure input assembly 503 and the electrical connector 500. The cylindrical protrusion 570 of the electrical connector 500 is engaged with the printed circuit board 505.

Figure 25:
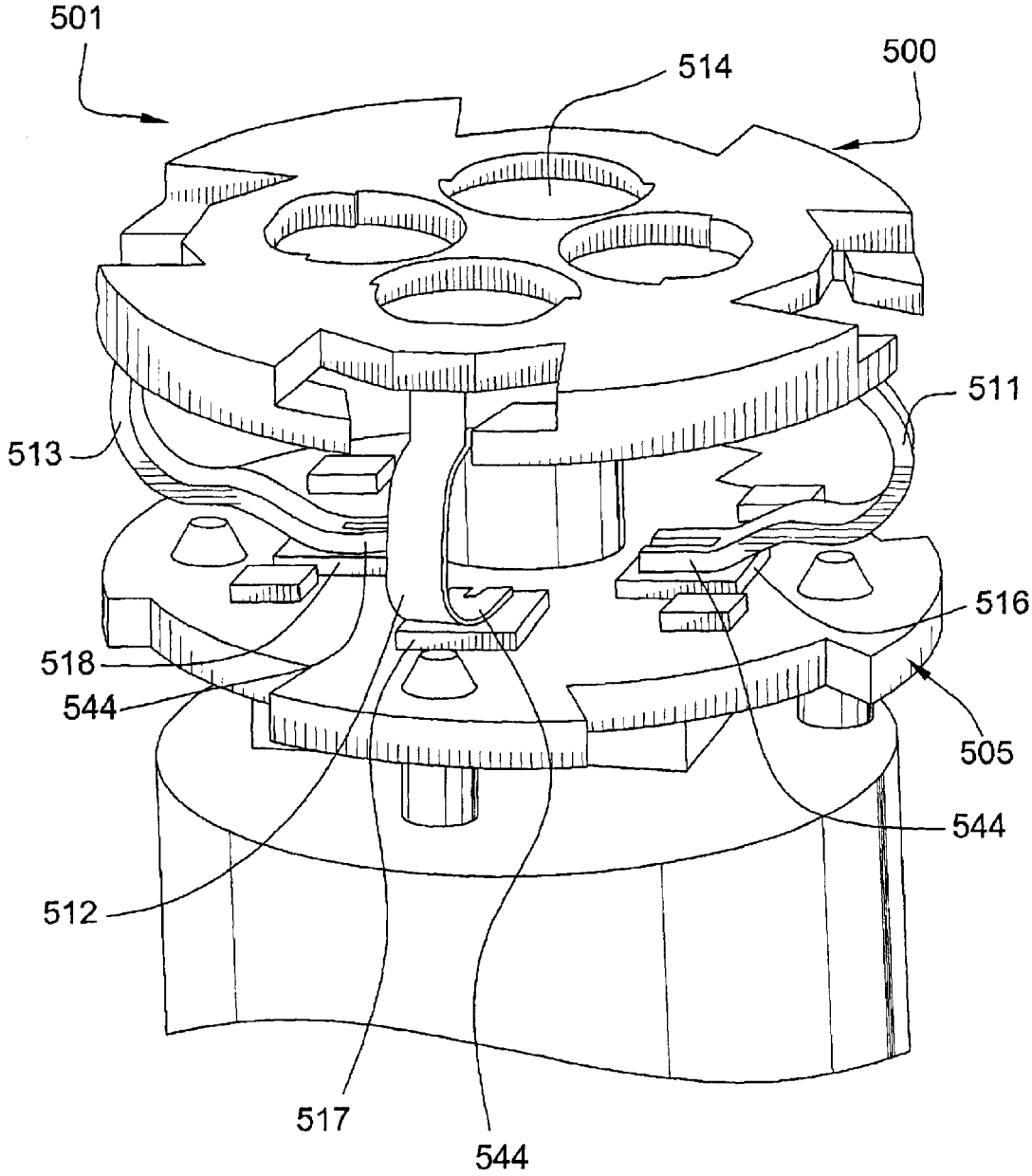
FIG. 25 is an enlarged fragmentary perspective view of the sensor of FIG. 23.
Figure 26:
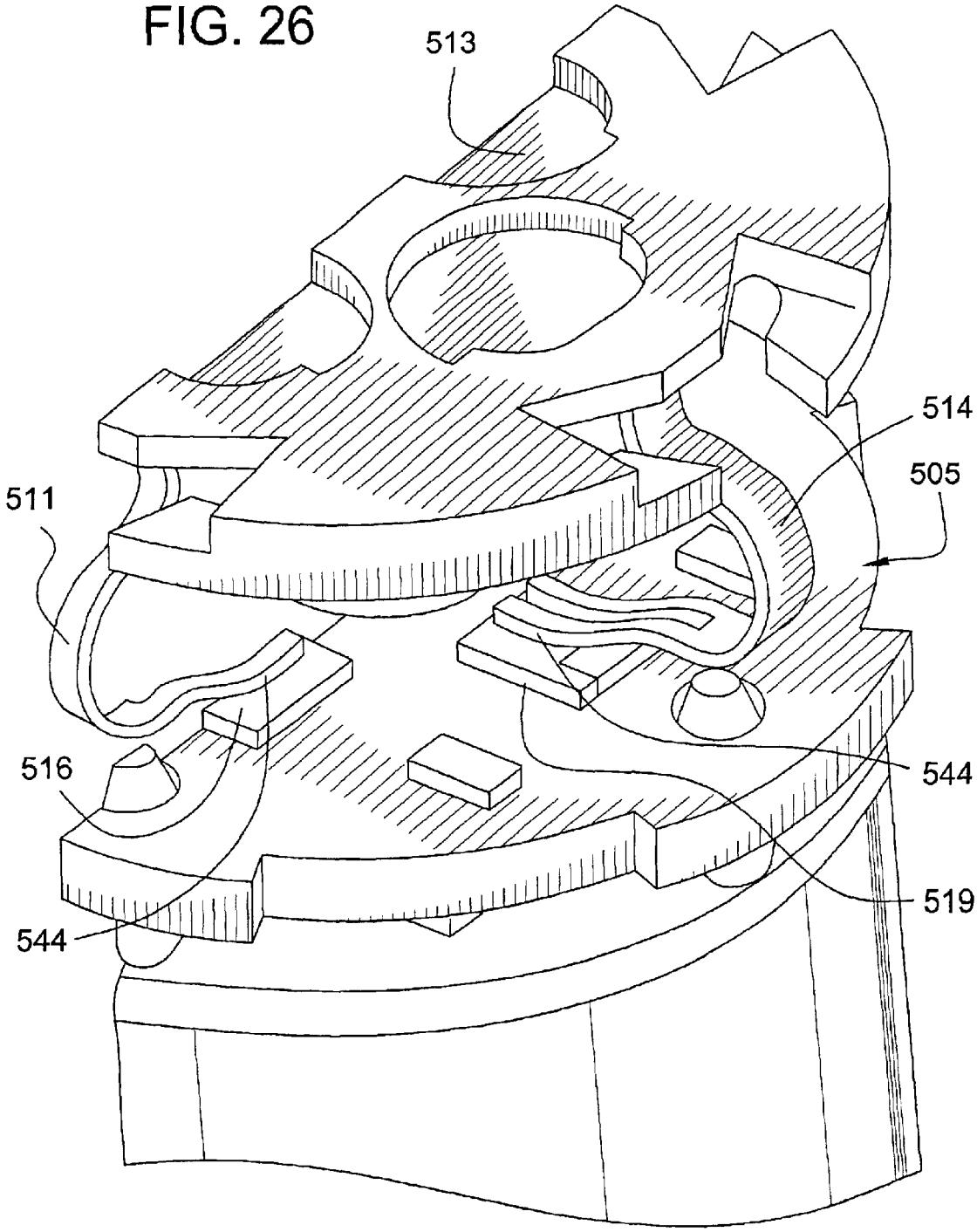
FIG. 26 is an enlarged fragmentary perspective view in section of the sensor of FIG. 23.

Referring to FIGS. 25 and 26, the contacts 511, 512, 513, 514 of the electrical connector 500 are electrically connected to a plurality of contact pads 516, 517, 518, 519, respectively, on the printed circuit board 505. The second contact portions 544 of the contacts 511, 512, 513, 514 are in contact with the contact pads 516, 517, 518, 519, respectively.

Figure 27:
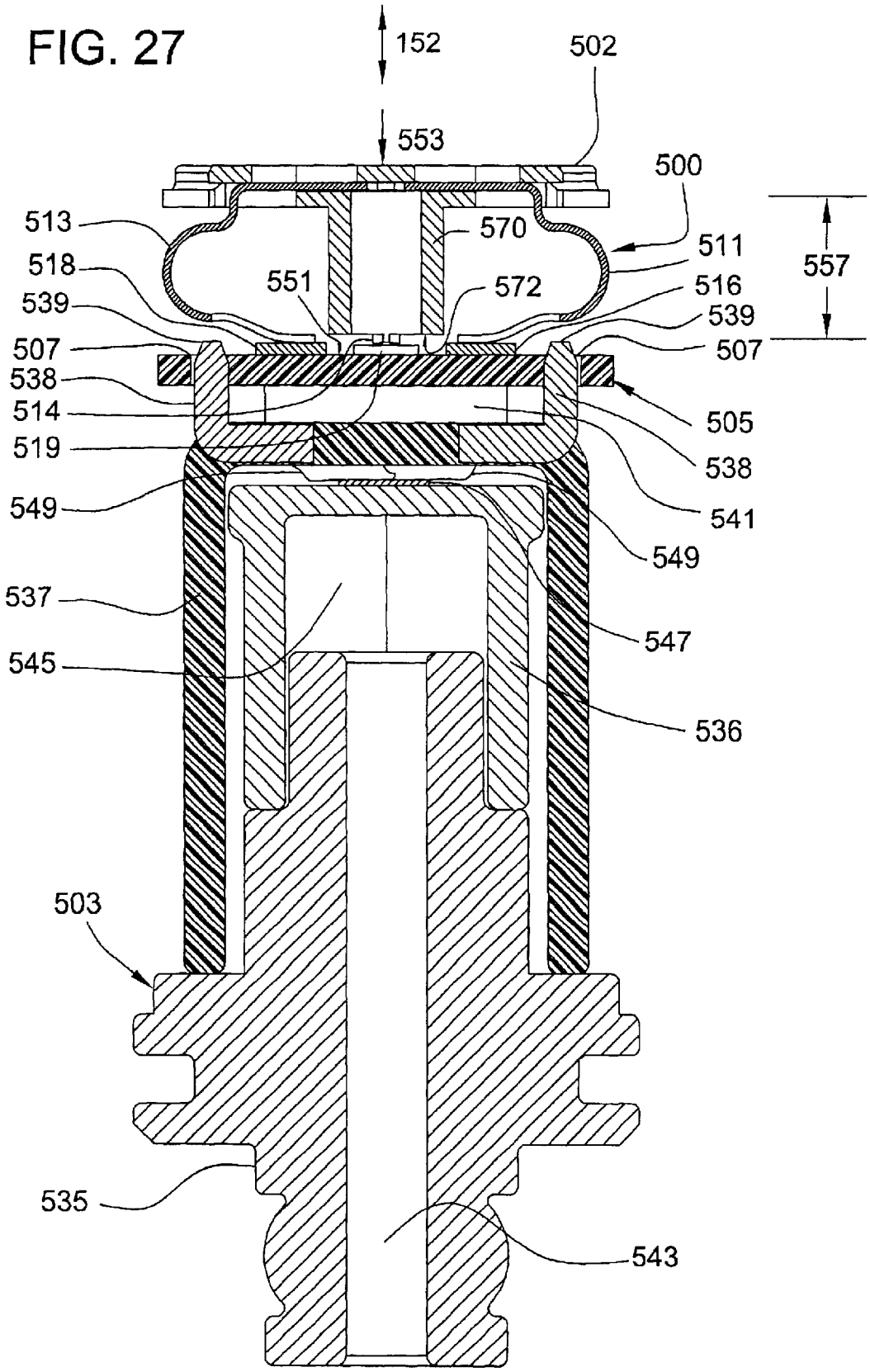
FIG. 27 is a cross-sectional view taken along line 27—27 in FIG. 24.
Figure 28:
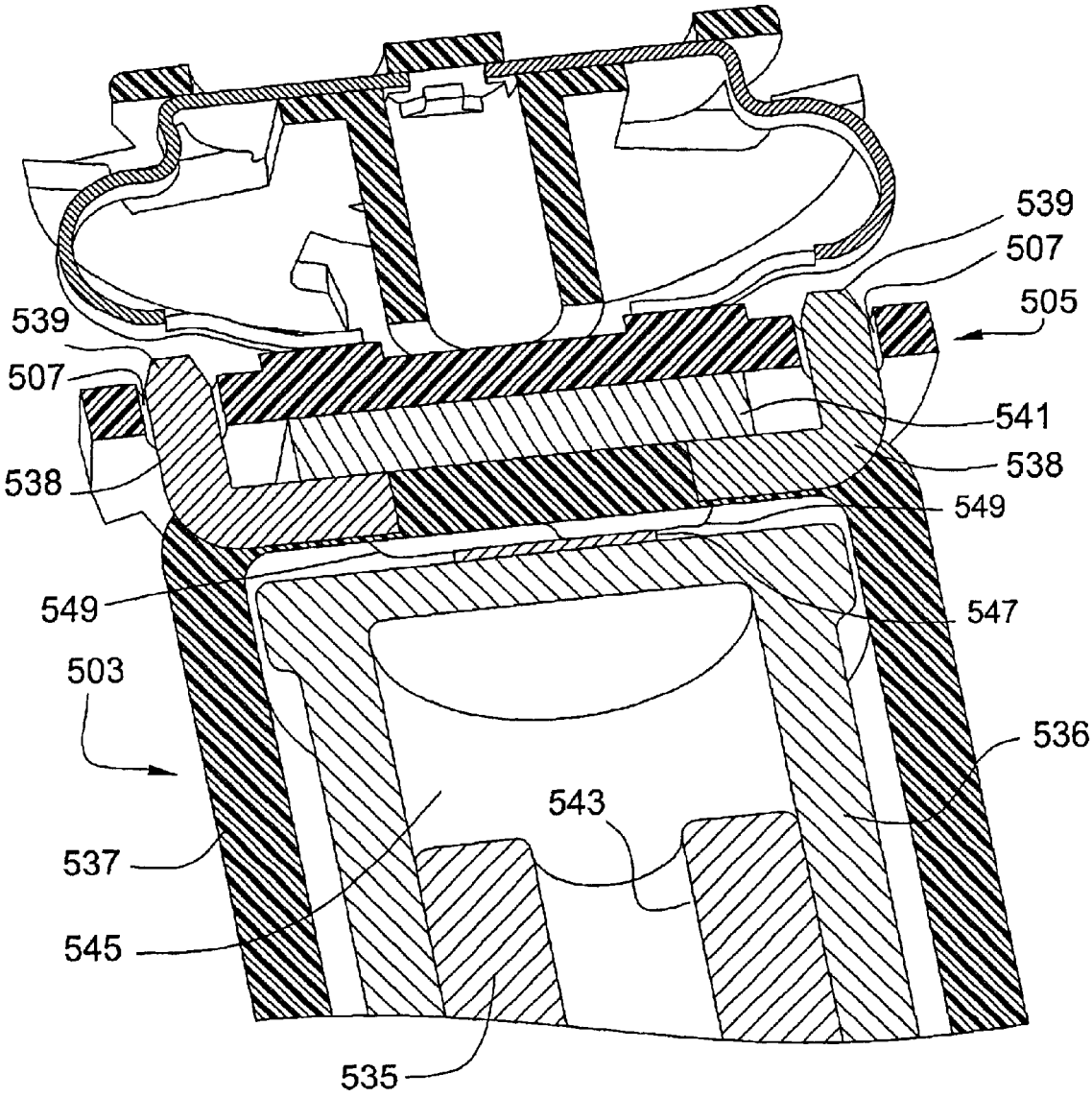
FIG. 28 is an enlarged fragmentary cross-sectional view as in FIG. 27 seen in perspective.

Referring to FIGS. 27 and 28, the pressure input assembly 503 includes an end cap 535, a pressure barrel 536, and an interface member 537. The pressure barrel 536 is mounted to the end cap 535. The interface member 537 is mounted to the end cap 535. A plurality of pins 538 is mounted to the interface member 537. The printed circuit board 505 is mounted to the pins 538. Each pin 538 includes an end 539 that extends through an aperture 507 in the printed circuit board 505.

The printed circuit board 505 includes a central processing unit in the form of an integrated circuit chip ("IC chip") 541. The IC chip 541 is electrically connected to the contact pads 516, 517, 518, 519 of the printed circuit board 505 which are in turn respectively electrically connected to the contacts 511, 512, 513, 514 of the electrical connector 500. The IC chip 541 is cooperatively arranged with the pressure input assembly 503.

Pressurized material, such as, brake fluid, for example, can flow through a bore 543 in the end cap 535 into a cavity 545 and act upon the pressure barrel 536, which in turn acts upon a wheatstone bridge 547 disposed between the pressure barrel 536 and the interface member 537. The wheatstone bridge 547 is electrically connected to the IC chip 541 via the pins 538. The wheatstone bridge 547 includes a plurality of leads 549 extending therefrom which are electrically connected to the pins 538.

As the pressure of the brake fluid varies so in turn does the force generated by the brake fluid upon the pressure barrel 536. The wheatstone bridge 547 can produce a variable electrical signal that varies in a known fashion according to the amount of force applied upon the pressure barrel 536, thereby providing an electrical signal that can indicate the magnitude of pressure of the brake fluid in the pressure input assembly 503. The wheatstone bridge 547 sends the electrical signal to the IC chip 541 which in turn can control a braking mechanism, for example, based upon the pressure of the brake fluid.

As shown in FIG. 27, the bottom surface 572 of the cylinder 570 of the electrical connector 500 is configured such that it can engage a top surface 551 of the printed circuit board 505. The electrical connector 500 can be compressed such that it moves in a compressive direction 553 substantially parallel to the vertical axis 152. Each of the contacts 511, 513, 514 of the electrical connector 500 act against the respective contact pads 516, 518, 519 of the printed circuit board 505. Each of the contacts compressively flexes. The housing 502 moves in the compressive direction 553 until the bottom surface 572 of the cylinder 570 contacts the top surface 551 of the printed circuit board 505. The cylinder 570 acts as an overstress prevention mechanism that protects the contacts from being stressed beyond a selected length 557.

Figure 29:
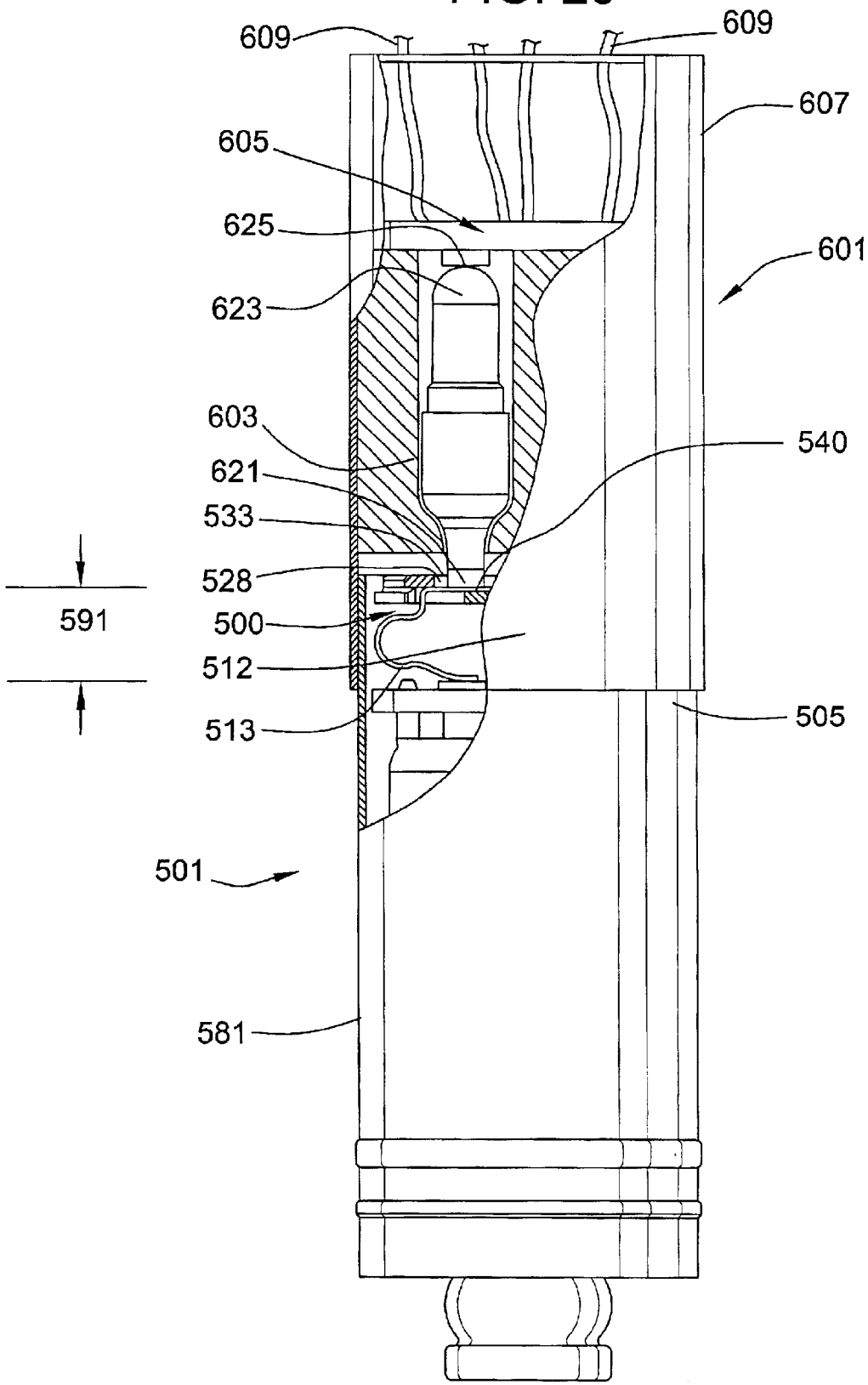
FIG. 29 is a partially broken away, side elevational view of the sensor of FIG. 23 and a partially broken away, side elevational view of a housing assembly.

Referring to FIG. 29, the electrical device 501 can include a shell 581. The electrical device 501 can be mated with another component 601 to provide an electrical connection between the electrical device 501 and the component 601. The component 601 includes a plurality of spring-loaded pin contacts 603, a printed circuit board 605, a housing 607, and a plurality of wires 609.

In the illustrative embodiment, the number of pin contacts 603 corresponds to the number of contacts in the electrical connector 500, i.e., four. Each pin contact 603 includes a first end 621 and a second end 623. The first end 621 of the pin contact 603 shown in FIG. 29 is electrically connected to the first contact portion 540 of the third contact 513. The first end 621 can fit within the aperture 533 of the third cavity 528 to contact the first contact portion 540 of the third contact 513. The second end 623 is electrically connected to a contact pad 625 of the printed circuit board 605. The four pin contacts 603 can provide separate electrical connections to the respective four contacts of the electrical connector 500. The four wires 609 are separately electrically connected to the respective four contact pads 625, which in turn are electrically connected to the four pin contacts 603. The wires 609 can be electrically connected to a plurality of brake mechanisms.

The component 601 and the device 501 can be mated together such that the electrical connector 500 is compressed between the housing 607 of the component 601 and the printed circuit board 505 of the device 501. The contacts of the electrical connector 500 are in a compressed position wherein the contacts have a length 591. In other embodiments the length 591 can be varied.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An electrical connector comprising:

a housing, the housing including a cavity and an insertion opening, the insertion opening communicating with the cavity, the cavity including a slot; and a contact, the contact mounted to the housing, the contact including a first contact portion, a second contact portion, and a body portion, the first contact portion having a retention member, the first contact portion being insertable into the insertion opening of the housing, the retention member engageable with the cavity of the housing, the first contact portion of the contact is generally circular-shaped and has a protrusion, and the protrusion being insertable into the slot of the housing.

2. The electrical connector of claim 1, wherein the body portion of the contact is generally C-shaped.

3. The electrical connector of claim 1, wherein the second contact portion of the contact has a slot defining a bifurcated contact surface with a pair of arms.

4. The electrical connector of claim 1, wherein the housing includes a cylinder, the cylinder configured to selectively limit the compressive deflection of the contact.

5. The electrical connector of claim 1, wherein the cavity of the housing includes a wall surface, the retention member retentively engaging the wall surface.

6. The electrical connector of claim 1, wherein the housing includes a first surface, a second surface, and a perimeter surface, the cavity includes an aperture, the aperture communicates with the first surface, the perimeter surface is broken by the insertion opening, and the body portion and the second contact portion of the contact depend from the second surface of the housing.

7. The electrical connector of claim 1, wherein the first contact portion is accessible through an aperture of the housing.

8. The electrical connector of claim 1, wherein the housing comprises a dielectric material.

9. The electrical connector of claim 1, wherein the protrusion of the first contact portion of the contact is a tongue.

10. The electrical connector of claim 1, wherein the first contact portion of the contact has a pair of retention members.

11. The electrical connector of claim 10, wherein the cavity includes a pair of side walls, the retention members of the contact retentively engaging the side walls.

12. The electrical connector of claim 1, wherein the body portion of the contact is disposed between the first contact portion and the second contact portion.

13. The electrical connector of claim 1, wherein the housing includes a plurality of insertion openings communicating with a corresponding plurality of cavities and further comprising a corresponding plurality of contacts, the contacts mounted to the housing.

14. The electrical connector of claim 1, wherein the cavity includes a pair of side walls and a pair of guide fins, the guide fins projecting toward each other from the side walls.

15. An electrical connector comprising a housing, the housing including a cavity and an insertion opening, the insertion opening communicating with the cavity, the cavity including a slot; and a contact, the contact mounted to the housing, the contact including a first contact portion, a second contact portion, and a body portion that is generally C-shaped, the first contact portion having a retention member, the first contact portion being insertable into the insertion opening of the housing, the retention member engageable with the cavity of the housing, the first contact portion of the contact having a protrusion, and the protrusion being insertable into the slot of the housing.

16. The electrical connector of claim 15, wherein the cavity of the housing includes a wall surface, the retention member retentively engaging the wall surface.

17. The electrical connector of claim 15, wherein the housing includes a first surface, a second surface, and a perimeter surface, the cavity includes an aperture, the aperture communicates with the first surface, the perimeter surface is broken by the insertion opening, and the body portion and the second contact portion of the contact depend from the second surface of the housing.

18. The electrical connector of claim 15, wherein the first contact portion is accessible through an aperture of the housing.

19. The electrical connector of claim 15, wherein the housing comprises a dielectric material.

20. The electrical connector of claim 15, wherein the protrusion of the first contact portion of the contact is a tongue.

21. The electrical connector of claim 15, wherein the first contact portion of the contact has a pair of retention members.

22. The electrical connector of claim 21, wherein the cavity includes a pair of side walls, the retention members of the contact retentively engaging the side walls.

23. The electrical connector of claim 15, wherein the body portion of the contact is disposed between the first contact portion and the second contact portion.

24. The electrical connector of claim 15, wherein the housing includes a plurality of insertion openings communicating with a corresponding plurality of cavities and further comprising a corresponding plurality of contacts, the contacts mounted to the housing.

25. The electrical connector of claim 15, wherein the cavity includes a pair of side walls and a pair of guide fins, the guide fins projecting toward each other from the side walls.

26. An electrical connector comprising:

a housing, the housing including a cavity and an insertion opening, the insertion opening communicating with the cavity, the cavity including a slot; and a contact, the contact mounted to the housing, the contact including a first contact portion, a second contact portion, and a body portion, the first contact portion having a retention member, the first contact portion being insertable into the insertion opening of the housing, the retention member engageable with the cavity of the housing, the first contact portion of the contact having a protrusion, and the protrusion being insertable into the slot of the housing, the second contact portion of the contact has a slot defining a bifurcated contact surface with a pair of arms.

27. The electrical connector of claim 26, wherein the cavity of the housing includes a wall surface, the retention member retentively engaging the wall surface.

28. The electrical connector of claim 26, wherein the housing includes a first surface, a second surface, and a perimeter surface, the cavity includes an aperture, the aperture communicates with the first surface, the perimeter surface is broken by the insertion opening, and the body portion and the second contact portion of the contact depend from the second surface of the housing.

29. The electrical connector of claim 26, wherein the first contact portion is accessible through an aperture of the housing.

30. The electrical connector of claim 25, wherein the housing comprises a dielectric material.

31. The electrical connector of claim 26, wherein the protrusion of the first contact portion of the contact is a tongue.

32. The electrical connector of claim 26, wherein the first contact portion of the contact has a pair of retention members.

33. The electrical connector of claim 32, wherein the cavity includes a pair of side walls, the retention members of the contact retentively engaging the side walls.

34. The electrical connector of claim 26, wherein the body portion of the contact is disposed between the first contact portion and the second contact portion.

35. The electrical connector of claim 26, wherein the housing includes a plurality of insertion openings communicating with a corresponding plurality of cavities and further comprising a corresponding plurality of contacts, the contacts mounted to the housing.

36. The electrical connector of claim 26, wherein the cavity includes a pair of side walls and a pair of guide fins, the guide fins projecting toward each other from the side walls.

37. An electrical connector comprising:

a housing, the housing including a cavity, a cylinder, and an insertion opening, the insertion opening communicating with the cavity, the cavity including a slot; and a contact, the contact mounted to the housing, the contact including a first contact portion, a second contact portion, and a body portion, the first contact portion having a retention member, the first contact portion being insertable into the insertion opening of the housing, the retention member engageable with the cavity of the housing, the first contact portion of the contact having a protrusion, and the protrusion being insertable into the slot of the housing, the compressive deflection of the contact being selectively limited by the cylinder of the housing.

38. The electrical connector of claim 37, wherein the cavity of the housing includes a wall surface, the retention member retentively engaging the wall surface.

39. The electrical connector of claim 37, wherein the housing includes a first surface, a second surface, and a perimeter surface, the cavity includes an aperture, the aperture communicates with the first surface, the perimeter surface is broken by the insertion opening, and the body portion and the second contact portion of the contact depend from the second surface of the housing.

40. The electrical connector of claim 37, wherein the first contact portion is accessible through an aperture of the housing.

41. The electrical connector of claim 37, wherein the housing comprises a dielectric material.

42. The electrical connector of claim 37, wherein the protrusion of the first contact portion of the contact is a tongue.

43. The electrical connector of claim 37, wherein the first contact portion of the contact has a pair of retention members.

44. The electrical connector of claim 43, wherein the cavity includes a pair of side walls, the retention members of the contact retentively engaging the side walls.

45. The electrical connector of claim 37, wherein the body portion of the contact is disposed between the first contact portion and the second contact portion.

46. The electrical connector of claim 37, wherein the housing includes a plurality of insertion openings communicating with a corresponding plurality of cavities and further comprising a corresponding plurality of contacts, the contacts mounted to the housing.

47. The electrical connector of claim 37, wherein the cavity includes a pair of side walls and a pair of guide fins, the guide fins projecting toward each other from the side walls.

48. An electrical contact comprising:

a first contact portion, the first contact portion having a retention member and a protrusion, the protrusion of the first contact portion being a tongue, the tongue being disposed on an insertion end of the first contact portion and opposing a necked area of the first contact portion;

a second contact portion; and a resiliently flexible body portion, the body portion disposed between the first contact portion and the second contact portion, the body portion of the contact being generally C-shaped.

49. The electrical contact of claim 48 wherein the first contact portion is generally circular-shaped.

50. The electrical contact of claim 48 wherein the first contact portion is generally planar.

51. The electrical contact of claim 48 wherein the second contact portion includes a contoured contact surface.

52. The electrical contact of claim 51 wherein the contoured contact surface is convex.

53. The electrical contact of claim 48 wherein the second contact portion has a slot.

54. The electrical contact of claim 53 wherein the slot defines a bifurcated contact surface with a pair of arms.

55. The electrical contact of claim 48 wherein the first contact portion includes a pair of retention members.

56. The electrical contact of claim 55 wherein the retention members are disposed on opposing sides of the first contact portion.

57. The electrical contact of claim 55 wherein the retention members each include a first protrusion having a first ramped surface and a second protrusion having a second ramped surface and a shoulder.

58. The electrical contact of claim 56 wherein the first and second protrusions define a recess disposed therebetween.

59. An electrical connector comprising:

a housing, the housing including a cavity and an insertion opening, the insertion opening communicating with the cavity, and the cavity including a seat and a support which both span between a pair of side walls of the cavity; and a contact, the contact mounted to the housing, the contact including a first contact portion, a second contact portion, and a body portion, the first contact portion having a retention member, the first contact portion being insertable into the insertion opening of the housing, the retention member engageable with the cavity of the housing;

wherein the seat and the support are offset from each other such that the first contact portion of the contact can fit therethrough.

60. The electrical connector of claim 59 wherein the retention member retentively engages at least one of the side walls of the cavity.

61. The electrical connector of claim 59 wherein the housing includes a first surface, a second surface, and a perimeter surface, the cavity includes an aperture, the aperture communicates with the first surface, the perimeter surface is broken by the insertion opening, and the body portion and the second contact portion of the contact depend from the second surface of the housing.

62. The electrical connector of claim 59 wherein the first contact portion is accessible through an aperture of the housing.

63. The electrical connector of claim 59 wherein the housing comprises a dielectric material.

64. The electrical connector of claim 59 wherein the first contact portion of the contact is generally circular-shaped.

65. The electrical connector of claim 59 wherein the cavity includes a slot, and the first contact portion of the contact has a protrusion, the protrusion being insertable into the slot of the housing.

66. The electrical connector of claim 65 wherein the protrusion of the first contact portion of the contact is a tongue.

67. The electrical connector of claim 59 wherein the first contact portion of the contact has a pair of retention members.

68. The electrical connector of claim 67 wherein the retention members of the contact retentively engage the side walls.

69. The electrical connector of claim 59 wherein the body portion of the contact is generally C-shaped.

70. The electrical connector of claim 59 wherein the body portion of the contact is disposed between the first contact portion and the second contact portion.

71. The electrical connector of claim 59 wherein the second contact portion of the contact has a slot.

72. The electrical connector of claim 71 wherein the slot of the second contact portion defines a bifurcated contact surface with a pair of arms.

73. The electrical connector of claim 59 wherein the housing includes a plurality of insertion openings communicating with a corresponding plurality of cavities and further comprising a corresponding plurality of contacts, the contacts mounted to the housing.

74. The electrical connector of claim 66 wherein the first contact portion is disposed upon the support, the tongue of the contact is inserted into the slot of the cavity, the cooperative arrangement of the tongue with the slot prevents the contact from moving along a vertical axis and prevents the contact from pivoting about the contact seat.

75. The electrical connector of claim 59 wherein the cavity includes a pair of guide fins, the guide fins projecting toward each other from the side walls.

76. The electrical connector of claim 59 wherein the housing includes a cylinder, the cylinder configured to selectively limit the compressive deflection of the contact.

77. An electrical connector comprising:

a housing, the housing including a cavity and an insertion opening, the insertion opening communicating with the cavity, and the cavity including a seat and a support which both span between a pair of side walls of the cavity; and a contact, the contact mounted to the housing, the contact including a first contact portion, a second contact portion, and a body portion, the first contact portion being insertable into the insertion opening of the housing;

wherein the seat and the support are offset from each other such that the first contact portion of the contact can fit therethrough.

78. The electrical connector of claim 77 wherein the housing includes a first surface, a second surface, and a perimeter surface, the cavity includes an aperture, the aperture communicates with the first surface, the perimeter surface is broken by the insertion opening, and the body portion and the second contact portion of the contact depend from the second surface of the housing.

79. The electrical connector of claim 77 wherein the first contact portion is accessible through an aperture of the housing.

80. The electrical connector of claim 77 wherein the housing comprises a dielectric material.

81. The electrical connector of claim 77 wherein the first contact portion of the contact is generally circular-shaped.

82. The electrical connector of claim 77 wherein the cavity includes a slot, and the first contact portion of the contact has a protrusion, the protrusion being insertable into the slot of the housing.

83. The electrical connector of claim 82 wherein the protrusion of the first contact portion of the contact is a tongue.

84. The electrical connector of claim 77 wherein the body portion of the contact is generally C-shaped.

85. The electrical connector of claim 77 wherein the body portion of the contact is disposed between the first contact portion and the second contact portion.

86. The electrical connector of claim 77 wherein the second contact portion of the contact has a slot.

87. The electrical connector of claim 86 wherein the slot of the second contact portion defines a bifurcated contact surface with a pair of arms.

88. The electrical connector of claim 77 wherein the housing includes a plurality of insertion openings communicating with a corresponding plurality of cavities and further comprising a corresponding plurality of contacts, the contacts mounted to the housing.

89. The electrical connector of claim 83 wherein the first contact portion is disposed upon the support, the tongue of the contact is inserted into the slot of the cavity, the cooperative arrangement of the tongue with the slot prevents the contact from moving along a vertical axis and prevents the contact from pivoting about the contact seat.

90. The electrical connector of claim 77 wherein the cavity includes a pair of guide fins, the guide fins projecting toward each other from the side walls.

91. The electrical connector of claim 77 wherein the housing includes a cylinder, the cylinder configured to selectively limit the compressive deflection of the contact.

* * * * *

UNITED STATES PATENT AND TRADEMARK OFFICE

CERTIFICATE OF CORRECTION

PATENT NO. : 6,860,766 B2
APPLICATION NO. : 10/094074
DATED : March 1, 2005
INVENTOR(S) : Aujla et al.

It is certified that error appears in the above-identified patent and that said Letters Patent is hereby corrected as shown below:

Column 6, Line 46: “respectively” should read --respectively.--.

Column 10, Line 50: “comprising” should read --comprising:--.

Signed and Sealed this

Fifteenth Day of April, 2008

JON W. DUDAS
*Director of the United States Patent and Trademark Office*